US011559995B2

(12) United States Patent
Yamasaki

(10) Patent No.: US 11,559,995 B2
(45) Date of Patent: Jan. 24, 2023

(54) PRINTER AND PRINTING METHOD

(71) Applicant: CASIO COMPUTER CO., LTD., Tokyo (JP)

(72) Inventor: Shuichi Yamasaki, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 294 days.

(21) Appl. No.: 16/817,360

(22) Filed: Mar. 12, 2020

(65) Prior Publication Data

US 2020/0307252 A1 Oct. 1, 2020

(30) Foreign Application Priority Data

Mar. 25, 2019 (JP) ..... JP2019-056204

(51) Int. Cl.
*A45D 29/00* (2006.01)
*B41J 3/407* (2006.01)

(52) U.S. Cl.
CPC ..... *B41J 3/4073* (2013.01); *A45D 29/00* (2013.01); *A45D 2029/005* (2013.01)

(58) Field of Classification Search
None
See application file for complete search history.

(56) References Cited

U.S. PATENT DOCUMENTS 8,721,068 B2 5/2014 Yamasaki
8,814,289 B2 8/2014 Yamasaki
8,919,898 B2 12/2014 Yamasaki
8,919,903 B2 12/2014 Yamasaki
9,004,625 B2 4/2015 Yamasaki
9,156,282 B2 10/2015 Yamasaki
9,254,026 B2 2/2016 Yamasaki
9,333,767 B2 5/2016 Yamasaki
9,486,050 B2 11/2016 Yamasaki
9,712,727 B2 7/2017 Yamasaki
9,731,494 B2 8/2017 Yamasaki
(Continued)

FOREIGN PATENT DOCUMENTS

CN 105313458 A 2/2016
CN 107187058 A 9/2017
(Continued)

OTHER PUBLICATIONS

Chinese Office Action (and English language translation thereof) dated Oct. 19, 2022, issued in counterpart Chinese Application No. 202010189402.6.

*Primary Examiner* — Erica S Lin
(74) *Attorney, Agent, or Firm* — Holtz, Holtz & Volek PC

(57) ABSTRACT

A printer includes a printing head, a nail information detection unit, an outline comparison determination unit, and a display unit. The printing head prints on a print target. The nail information detection unit detects a base outline that is a base outline in an area including the print target and a non-print target adjacent to the print target. The outline comparison determination unit compares a print outline that is an outline of an area to be printed on the print target with the base outline, and determines whether or not there is a difference equal to or larger than a set value. The display unit reports, as a reporting unit, to a user that the difference determined by the outline comparison determination unit is equal to or larger than the set value.

9 Claims, 15 Drawing Sheets

(56) References Cited

U.S. PATENT DOCUMENTS

| | | | | |
|---|---|---|---|---|
| 9,781,989 | B2 | 10/2017 | Yamasaki | |
| 9,808,068 | B2 | 11/2017 | Yamasaki | |
| 9,820,547 | B2 | 11/2017 | Yamasaki | |
| 10,029,477 | B2 | 7/2018 | Yamasaki | |
| 10,278,472 | B2 | 5/2019 | Yamasaki | |
| 10,292,475 | B2 | 5/2019 | Yamasaki | |
| 2013/0038647 | A1* | 2/2013 | Hashimoto | B41J 29/02 347/2 |
| 2013/0106970 | A1 | 5/2013 | Yamasaki | |
| 2015/0375526 | A1 | 12/2015 | Yamasaki | |
| 2017/0193651 | A1 | 7/2017 | Yamasaki | |
| 2018/0272750 | A1 | 9/2018 | Yamasaki | |
| 2018/0272751 | A1 | 9/2018 | Yamasaki | |
| 2019/0208886 | A1 | 7/2019 | Yamasaki | |
| 2019/0313764 | A1 | 10/2019 | Yamasaki | |

FOREIGN PATENT DOCUMENTS

| | | | |
|---|---|---|---|
| JP | 2017154502 | A | 9/2017 |
| JP | 6458426 | B2 | 1/2019 |

* cited by examiner

PRINTER AND PRINTING METHOD

BACKGROUND OF THE INVENTION

1. Field of the Invention

The present invention relates to a printer and a printing method.

2. Description of the Related Art

Conventionally, as a printer, a nail printer that prints a favorite nail design on a print target such as a person's nail is known (for example, refer to JP 2003-534083 A).

By using such a device, a user can easily enjoy nail printing without using a nail salon.

When printing is performed on a print target such as a nail, a beautiful nail print cannot be performed unless the outline of an area where printing is performed (this is referred to as a "printing area") is correctly detected.

In this regard, when printing is performed on a nail or the like, a white or other base may be applied in advance to a surface of the nail that is a print target to improve color development or the like.

When a base is applied to a nail or the like, an area where the base is applied (base area) is detected as a print target area where printing should be performed.

SUMMARY OF THE INVENTION

An aspect of the present invention is a printer, including:

a printing head configured to print on a printing area of a print target;

a processor configured to detect a base outline that is an outline of a print target area in an area including the print target and a non-print target adjacent to the print target;

wherein the processor determines whether or not there is a difference equal to or larger than a set value by comparing a print outline, which is an outline of an area to be printed on the print target, with the base outline, and instructs to report when the difference is equal to or larger than the set value.

DETAILED DESCRIPTION OF THE PREFERRED EMBODIMENTS

An embodiment of a printer and a printing method according to the present invention will be described with reference to FIGS. 1 to 19.

In the embodiment to be described below, technically preferable various limitations are applied to implement the present invention. However a scope of the present invention is not limited to the embodiment to be described below and illustrated examples.

Further, in the embodiment to be described below, the case where the printer is a nail printer that prints on a person's nail will be described as an example, but the printer in the present invention is not limited to a nail printer. In addition, a case is illustrated where the nail printer prints on fingernails of hands as a print target, but when the printer in the present invention is a nail printer, the print target is not limited to fingernails of hands, and may be, for example, toenails. In addition, the print target may be an object other than nails, such as a surface of a nail chip and various accessories.

Figure 1:
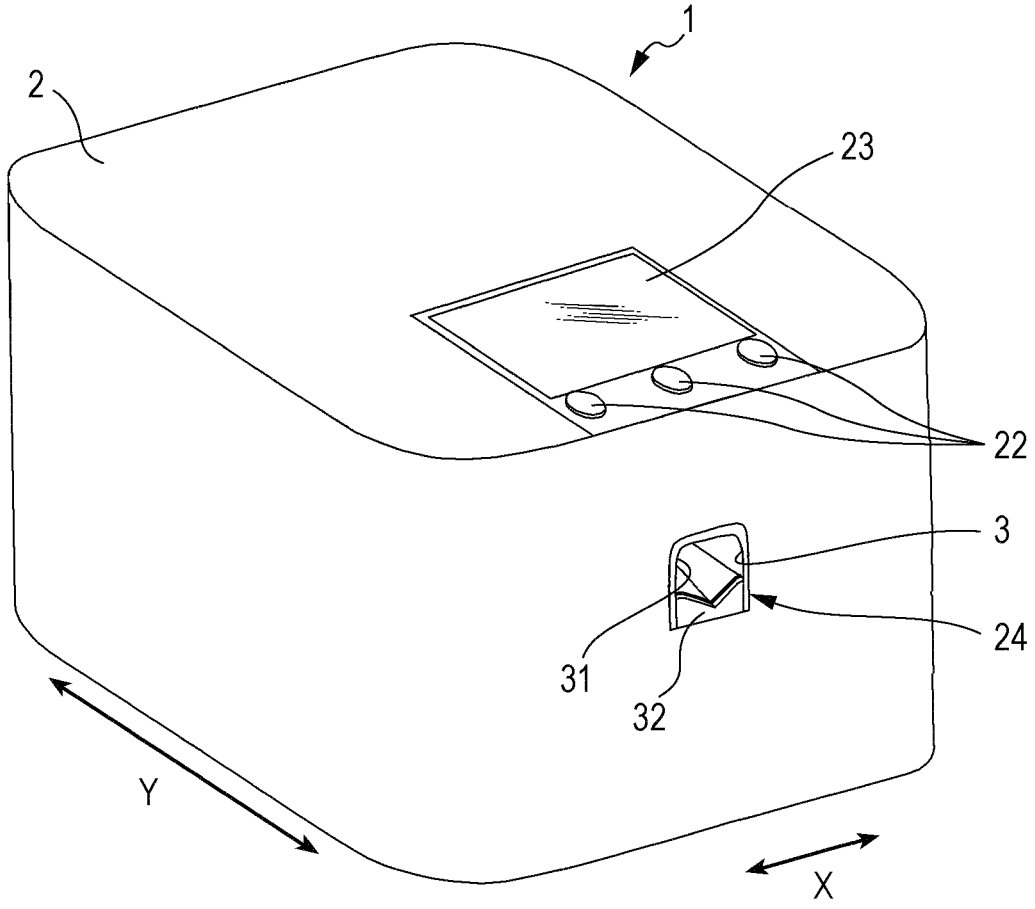
FIG. 1 is a perspective view of an external configuration of a nail printer according to an embodiment described herein.

FIG. 1 is an external perspective view of a nail printer which is a printer according to the present embodiment.

As illustrated in FIG. 1, a nail printer 1 according to the present embodiment has a housing 2 formed in a substantially box shape.

An operation unit 22 is provided on an upper surface (top plate) of the housing 2.

The operation unit 22 is an input unit, and a user performs various input by using the input unit.

The operation unit 22 includes operation buttons for performing various input, including a power switch button for turning on the nail printer 1, a stop switch button for stopping an operation, a design selection button for selecting a design image to be printed on the nail T, and a printing start button for starting printing.

Further, in the present embodiment, the operation unit 12 includes a touch panel-type input unit 222 (hereinafter simply referred to as "touch panel 222" in FIG. 3 and the following description) provided in a display unit 23 to be described later.

In addition, the display unit 23 is provided on an upper surface (top plate) of the housing 2.

The display unit 23 includes, for example, a liquid crystal display (LCD), an organic electroluminescence display, and other flat display.

The touch panel 222 is integrally formed on a surface of the display unit 23 of the present embodiment. The touch panel 222 performs various inputs by a touch operation of touching the surface of the display unit 23 with an input member such as a fingertip, a stylus pen (hereinafter, simply referred to as a "pen"), or a pointed bar-shaped writing instrument and functions as the operation unit 22.

In the embodiment, this display unit 23 appropriately displays, for example, a nail image obtained by photographing a finger U (refer to FIG. 4A and the like) (that is, an image of the finger U including an image of the nail T), an image of an outline or the like of a nail included in the nail image, a design selection screen for selecting a nail design to be printed on a nail, a thumbnail image for design confirmation, an instruction screen for displaying various instructions, a notification screen, and a warning screen.

In particular, in the present embodiment, an outline comparison determination unit 813 compares print outlines Cr and Cd (refer to FIGS. 6A and 8A and the like) with a base outline Cb (refer to FIGS. 9B and 11A and the like) as described later to determine whether or not there is a difference equal to or larger than a set value. The display unit 23 functions as a notification unit that notifies a user when the difference determined by the outline comparison determination unit 813 is equal to or larger than a set value.

When the difference determined by the outline comparison determination unit 813 is equal to or larger than a set value, the display unit 23 may display a display screen that prompts the user to correct the base outline Cb.

Further, when the display unit 23 functions as the touch panel 222, and when the outline of the nail T (the outline of a nail area, a registered outline Cr) or a base area (base outline Cb) to be described later is automatically recognized, on the display unit 23, a nail outline correction screen or the like for correcting the recognition result is displayed, and the user may be able to manually correct the result on the screen using a pen or the like.

Further, on the front side of the housing 2 (the front side in FIG. 1), that is substantially in the center of the nail printer 1 in the X direction (the X direction in FIG. 1), an opening 24 is formed for inserting a finger corresponding to a nail to be printed at the time of photographing by the nail printer 1 or at the time of printing operation by a printing unit 40 and for setting the nail at a photographable position where photographing can be performed by the photographing unit 50 and a printing position where printing can be performed by the printing unit 40.

The finger fixing mechanism 3 for fixing the finger U having the nail T (refer to FIG. 4 and the like) is disposed inside the opening 24, as described later.

Figure 2:
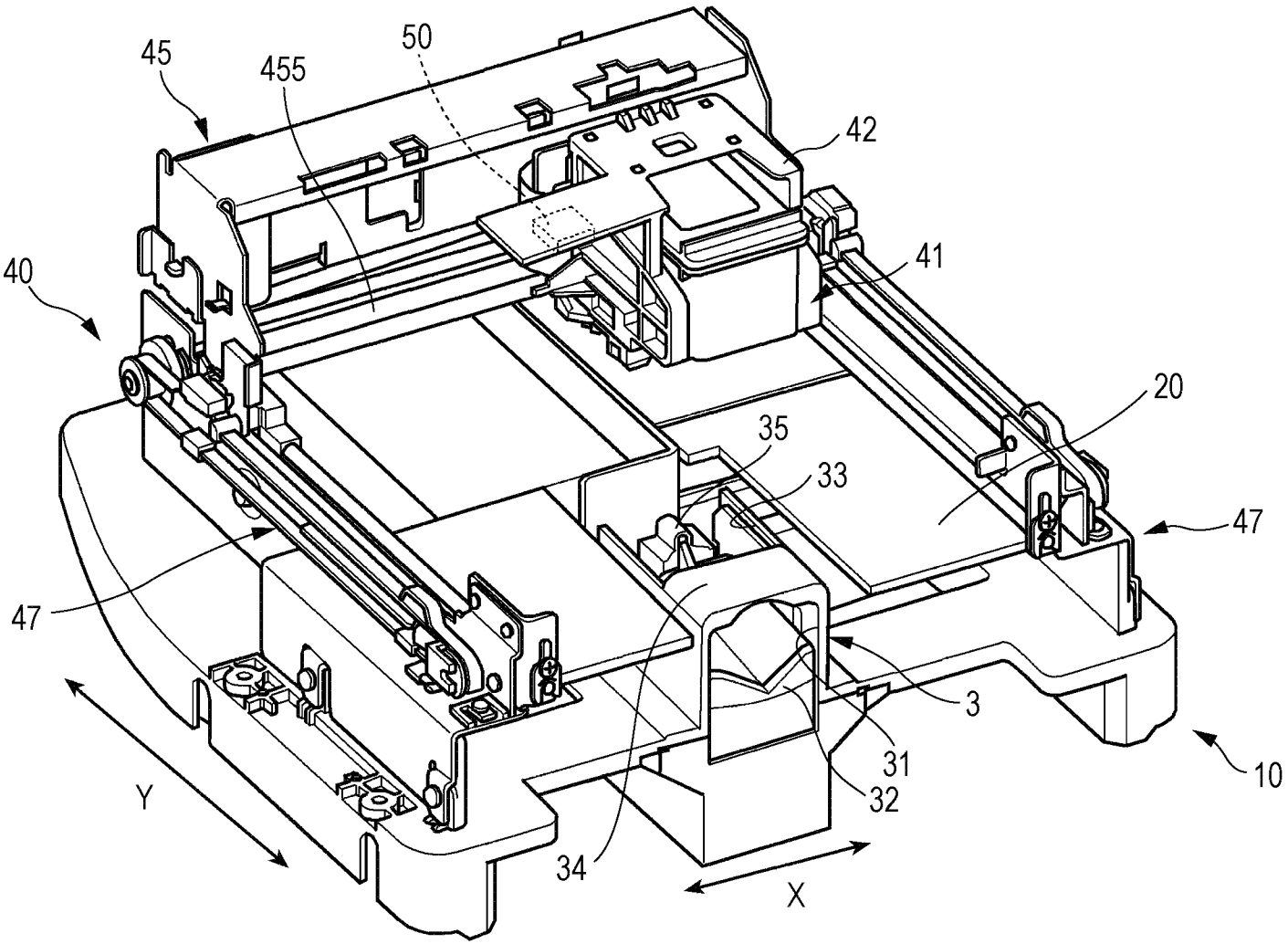
FIG. 2 is a perspective view of a main portion indicating an internal configuration of the nail printer from which a housing is removed.

FIG. 2 is a perspective view of a main part indicating an internal configuration of the nail printer 1 with the housing 2 removed from the nail printer 1 of FIG. 1.

As illustrated in FIG. 2, a base 10 in which various internal structures are incorporated is provided in the housing 2.

A position on the front side of the device on a base upper surface 20 (front side in the Y direction in FIG. 2), substantially at the center in the width direction of the device (X direction in FIG. 2), and at a position corresponding to the opening 24 of the housing 2, a finger fixing mechanism 3 is disposed.

The finger fixing mechanism 3 has a mechanism for stably holding the finger U having the nail T to be printed.

The finger fixing mechanism 3 is a box-shaped member having an opening 31 on the device front side, and a finger fixing member 32 for fixing a finger is disposed inside the finger fixing mechanism 3.

The finger fixing member 32 pushes and supports the finger U from the lower side, and is made of, for example, a flexible resin or the like. In the present embodiment, the finger fixing member 32 has a shape in which a substantially central portion in the width direction (X direction in FIG. 2) is depressed, and when the finger U is placed on the finger fixing member 32, the finger fixing member 32 receives the cushion portion of the finger U to prevent the finger from rattling in the device width direction (X direction in FIGS. 1 and 2).

The back side of the top surface of the finger fixing mechanism 3 is a window 33 that opens. The nail T of the finger U inserted into the finger fixing mechanism 3 is exposed from the window 33.

Further, the front side of the top surface of the finger fixing mechanism 3 is a finger holding portion 34 that prevents the finger from lifting and regulates the upper position of the finger U.

Further, in the present embodiment, on the far side in the finger insertion direction, a nail placing unit 35 is provided for placing the tip portion of the nail T to be printed and regulating the position of the nail T in the height direction. By placing the tip of the nail T on the upper surface of the nail placing unit 35, the position of the nail T in the horizontal direction (that is the X direction and the Y direction) is defined, and the position of the nail T in the height direction is also regulated.

Note that the finger fixing mechanism 3 may be detachable such that it can be removed from the inside of the device.

Further, the printing unit 40 for performing printing on a print target surface (that is, the surface of the nail T to be printed) is provided inside the housing 2.

The printing unit 40 prints on a printing area set based on a determination result by an outline comparison determination unit 813 described below.

The printing unit 40 includes a printing head 41, a head carriage 42, an X direction moving motor 46, a Y direction moving stage 47, and a Y direction moving motor 48. The head carriage supports the printing head 41. The X direction moving motor 46 constitutes a moving mechanism for moving the printing head 41 in the X direction (the X direction in FIGS. 1 and 2 and the like and the left and right direction of the nail printer 1) (refer to FIG. 3). The Y direction moving stage 47 and the Y direction moving motor 48 move the printing head 41 in the Y direction (the Y direction in FIGS. 1 and 2, front and back direction of the nail printer 1) (refer to FIG. 3).

In the present embodiment, the printing head 41 (the head carriage 42 supporting the printing head 41) is slidably attached to a guide shaft 455 (refer to FIG. 2) extending in the X direction (X direction in FIGS. 1 and 2, etc., right and left direction of the nail printer 1).

Further, the printing head 41 (head carriage 42 supporting printing head 41) is configured to be movable along the Y direction (Y direction in FIGS. 1, 2, and the like, front and back direction of the nail printer 1) while being supported by the guide shaft 455 on the Y direction moving stage 47 provided to extend in the Y direction.

The printing head 41 of the present embodiment is an inkjet head that performs printing by an inkjet method.

The printing head 41 is an ink cartridge-integrated head in which ink cartridges (not illustrated) and an ink ejection surface (not illustrated) are integrally formed. The ink cartridges correspond to inks of, for example, yellow (Y: YELLOW), magenta (M: MAGENTA), and cyan (C: CYAN). The ink ejection surface is provided on a surface opposing to a print target (a surface of the nail T) in each ink cartridge. On the ink ejection surface, ejection ports (ink ejection ports, not illustrated) of a nozzle array composed of a plurality of nozzles for ejecting ink of each color are formed in a row. The printing head 41 performs printing by atomizing ink and spraying ink directly from the ink ejection surface (ink ejection port of the ink ejection surface) to the surface of a nail. Note that the printing head 41 is not limited to one that ejects the above three colors of ink. An ink cartridge for storing other inks and an ink ejection port may be further included.

In the present embodiment, a head moving mechanism 49 (refer to FIG. 3) that can move the printing head 41 in the X direction and the Y direction on the XY plane by the X direction moving motor 46, the Y direction moving motor 48, and the like is formed. The operation of the head moving mechanism 49 is controlled by a control device 80 (particularly, a print control unit 815, refer to FIG. 3) to be described later.

Further, in the present embodiment, the photographing unit 50 is attached to a part of the head carriage 42 that supports the printing head 41. Specifically, the upper surface of the head carriage 42 partially protrudes laterally, and the photographing unit 50 is provided on a lower surface of the protruding portion.

The photographing unit 50 is a photographing unit that photographs the nail T and obtains a nail image that is an image of the finger U including the nail T. The photographing unit 50 includes a photographing device 51 and a lighting device 52.

The photographing unit 50 of the present embodiment fixes the finger U to the finger fixing mechanism 3, illuminates the nail T with the lighting device 52 in a state where the tip of the nail is placed on the nail placing unit 35, and photographs with the photographing device 51.

The photographing unit 50 is connected to a photographing control unit 811 (refer to FIG. 3) in the control device 80 to be described later and controlled by the photographing control unit 811.

Image data of an image photographed by the photographing unit 50 is stored in a nail information storage region 822 to be described later.

The photographing unit 50 of the present embodiment is configured to be movable in the X and Y directions by the head moving mechanism 49 including the X direction moving motor 46 and the Y direction moving motor 48 and the like.

Note that the photographing unit 50 only needs to be able to photograph the nail T disposed in the finger fixing mechanism 3, and the specific arrangement and the like are not particularly limited.

A moving mechanism for moving the photographing unit 50 in the X direction and the Y direction may be provided separately from the head moving mechanism 49, and the photographing unit 50 may be moved by the moving mechanism. Further, the photographing unit 50 may be fixedly disposed inside the upper surface (top plate) of the housing 2 and above the window 33 of the finger fixing mechanism 3.

The control device 80 is provided on, for example, a substrate (not illustrated) disposed on the lower surface side of the top surface of the housing 2 (that is, the inner surface of the device) or the like. In addition to a main substrate disposed on the lower surface side of the top surface of the housing 2, a substrate may be provided separately on the X direction moving stage 45, the head carriage 42, and the like. In this case, a plurality of the substrates is electrically connected to each other, such that each unit is collectively controlled and operates in cooperation.

Figure 3:
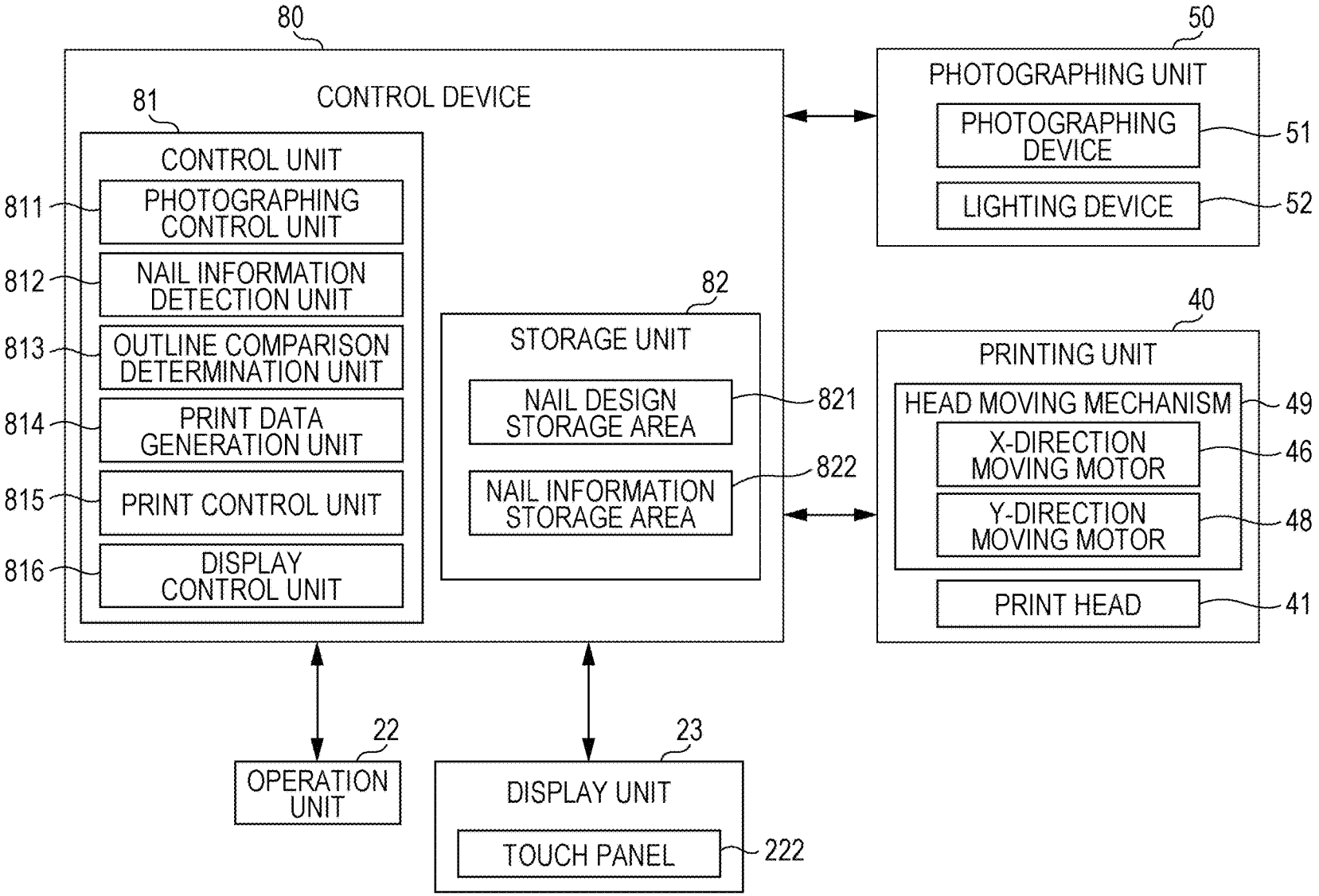
FIG. 3 is a block diagram of a main portion indicating a control configuration of a nail printer according to the embodiment.

FIG. 3 is a block diagram of a main portion indicating a control configuration according to the embodiment.

The control device 80 is a computer including the control unit 81 and a storage unit 82 as illustrated in FIG. 3. The control unit 81 includes a central processing unit (CPU) (not illustrated) and the like. The storage unit 82 includes read only memory (ROM) (not illustrated) and random access memory (RAM) (not illustrated).

The storage unit 82 stores various-types of programs and data to operate the nail printer 1.

Specifically, the storage unit 82 stores various programs such as a nail information detection program for detecting, from a nail image, various types of nail information such as the shape of the nail T (nail area), the outline of the nail T (print outline), the width of the nail T, and the curvature of the nail T, an outline comparison/determination program for comparing and determining a print outline with a base outline, a print data generation program for generating print data, and a printing program for performing printing processing. When these programs are executed by the control device 80, each unit of the nail printer 1 is controlled overall.

Further, the storage unit 82 of the present embodiment is provided with a nail design storage region 821, the nail information storage region 822, and the like. The nail design storage region 821 stores image data of a nail design to be printed on the nail T. The nail information storage region 822 stores the user's nail image of the nail T obtained by the photographing unit 50, various types of nail information obtained by analyzing the nail image (outline of the nail T, width of the nail T, inclination angle of the nail T (curvature of the nail T), etc.).

Figure 4A:
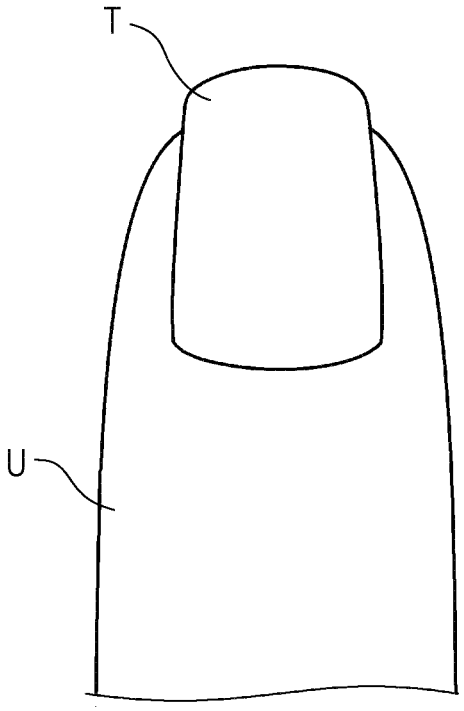
FIG. 4A is a diagram illustrating an example of a nail image.
Figure 4B:
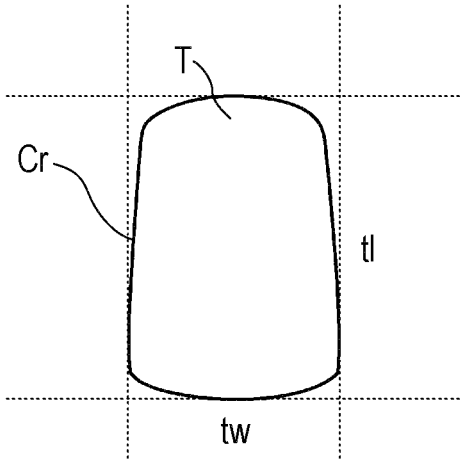
FIG. 4B is a diagram illustrating an example of an outline of a nail area detected from the nail image of FIG. 4A.

The nail information storage region 822 stores a registered outline Cr and the like already registered as the outline of the nail T (refer to FIG. 4B and the like).

In the present embodiment, the area to be printed is the whole or a part of the nail area, which is the surface of the nail T, and is the area of the nail T to which a nail design is fitted.

For example, when a nail design for the entire nail (such as nail design Da in FIG. 5) is printed on the surface of the nail T, the entire nail area is the area to be printed. Specifically, if the nail design Da that the user wants to print is a design to be printed on the entire nail (refer to FIG. 6A), the entire area of the nail on which the nail design Da is placed is the area to be printed. At this time, the outline of the area to be printed matches the registered outline Cr. Further, when a nail design for a part of a nail (such as the nail design Df in FIG. 7) is printed on a part of the nail area, the portion is the area to be printed. Specifically, when the nail design Df that the user wants to print is a French nail that is printed only on a tip of a nail (refer to FIG. 8A), the tip portion where the nail design Df is disposed is the area to be printed.

In a functional view, the control unit 81 includes the photographing control unit 811, a nail information detection unit 812, the outline comparison determination unit 813, a print data generation unit 814, the print control unit 815, and a display control unit 816. Functions as the photographing control unit 811, the nail information detection unit 812, the outline comparison determination unit 813, the print data generation unit 814, the print control unit 815, the display control unit 816, and the like are realized by cooperation between the CPU of the control unit 81 and the program stored in the storage unit 82.

The photographing control unit 811 controls the photographing device 51 and the lighting device 52 of the photographing unit 50, and the photographing device 51 photographs an image of the finger U including an image (nail image) of the nail T of the finger U fixed to the finger fixing mechanism 3.

In the present embodiment, the photographing control unit 811 controls the photographing unit 50, photographs the nail T before applying a base to obtain a nail image. Further, after the base is applied to the surface of the nail T, the current nail T is photographed to obtain the current nail image, for example, immediately before printing is actually performed.

Image data of a nail image obtained by the photographing unit 50 may be stored in the nail information storage region 822 in the storage unit 82.

The nail information detection unit 812 detects nail information based on a nail image photographed by the photographing device 51.

Here, the nail information includes, for example, the XY coordinates of the horizontal position of the nail T, the height of the nail T (position of the nail T in the vertical direction, the vertical position of the nail T), a curvature (degree of curvature) of the nail T, and the like. Note that the nail information is not limited to the information illustrated herein.

In the present embodiment, the nail information detection unit 812 functions as an outline detection unit that detects the outline of the nail T (the outline of the nail area, the shape of the nail).

These pieces of nail information are detected by the nail information detection unit 812 analyzing nail images. The specific method of the analysis is not particularly limited, and various image analysis methods can be applied.

The nail information as a result detected by the nail information detection unit 812 is stored in the nail information storage region 822 of the storage unit 82.

Specifically, the nail information detection unit 812 detects in advance the entire outline of the user's nail T (the surface of the nail T), which is the area to be printed, before a base or the like is applied. The outline of the nail T detected in advance by the nail information detection unit 812 is stored in the nail information storage region 822 as a registered outline (registered outline Cr, refer to FIG. 4B and the like). Further, when the nail design Df is fitted to the nail T, the nail information detection unit 812 detects the outline of a part of the nail T of the user to which the nail design Df has been fitted before a base or the like is applied as the area to be printed. Note that the information on the outline detected here need not be stored in the nail information storage region 822.

For example, if the user's finger U is the finger U having the nail T as illustrated in FIG. 4A, the nail information detection unit 812 detects the outline (registered outline Cr) of the nail T that defines the nail area, as illustrated in FIG. 4B.

The detection of the outline of the nail T by the nail information detection unit 812 is performed by, for example, analyzing a nail image and detecting a difference in color or brightness between the nail T and the skin portion of the finger U or the like. Note that the detection method is not particularly limited. Various types of pattern matching may be used. The detection of the outline of the nail T is preferably performed for the ten fingers U of the right and left hands, and is preferably stored in the nail information storage region 822 in association with the finger type or the like.

Further, in the present embodiment, the nail information detection unit 812 sets a circumscribed rectangle (such as a circumscribed rectangle Ft in FIG. 6B and the like) in contact with the outer periphery (outline of the nail T) of the nail area. Then, the length (width) in the nail width direction of the circumscribed rectangle Ft is denoted by "tw", and the length (vertical length, nail length) of the nail T in the extending direction (from the root of the nail T to the tip) is denoted by "tl". Each value is stored in the nail information storage region 822.

The target to be stored in the nail information storage region 822 is not limited to the horizontal width tw and the vertical length (nail length) tl of the circumscribed rectangle. For example, it may be the aspect ratio of the circumscribed rectangle (for example, tl/tw), or the outline of the nail T (the coordinate position of each point constituting the outline (registered outline Cr)). Furthermore, the user selects a whole nail design (such as the nail design Da in FIG. 5) as a nail design to be printed on the nail T, when the nail design Da is fitted to the nail T, the outline of the nail design Da and the circumscribed rectangle that touches the outline may be stored in the nail information storage region 822. The target to be stored in the nail information storage region 822 may be a part or all of these pieces of information.

In addition, the registered outline Cr, the circumscribed rectangle Ft, and the like may be obtained at any timing. For example, the user obtains the nail printer 1 and detects the outline of the user's nail T as one of initial settings, and the outline may be stored (registered) in association with a finger type such as which one of the left and right fingers. If a single nail printer 1 is used by a plurality of persons, information for distinguishing users is also associated.

When printing is performed on the entire nail T (for example, when the nail design Da selected by a user is a design to be printed on the entire nail), the nail information detection unit 812 detects the outline of the area to be printed on which the nail design Da is applied on the nail area, as the print outline Ct.

In this case, when the user selects the nail design Da as the nail design to be applied to the nail T, the nail information detection unit 812 reads the registered outline Cr from the nail information storage region 822 as the outline of the area to be printed where the nail design Da of the nail area is printed (print outline Ct).

Figure 5:
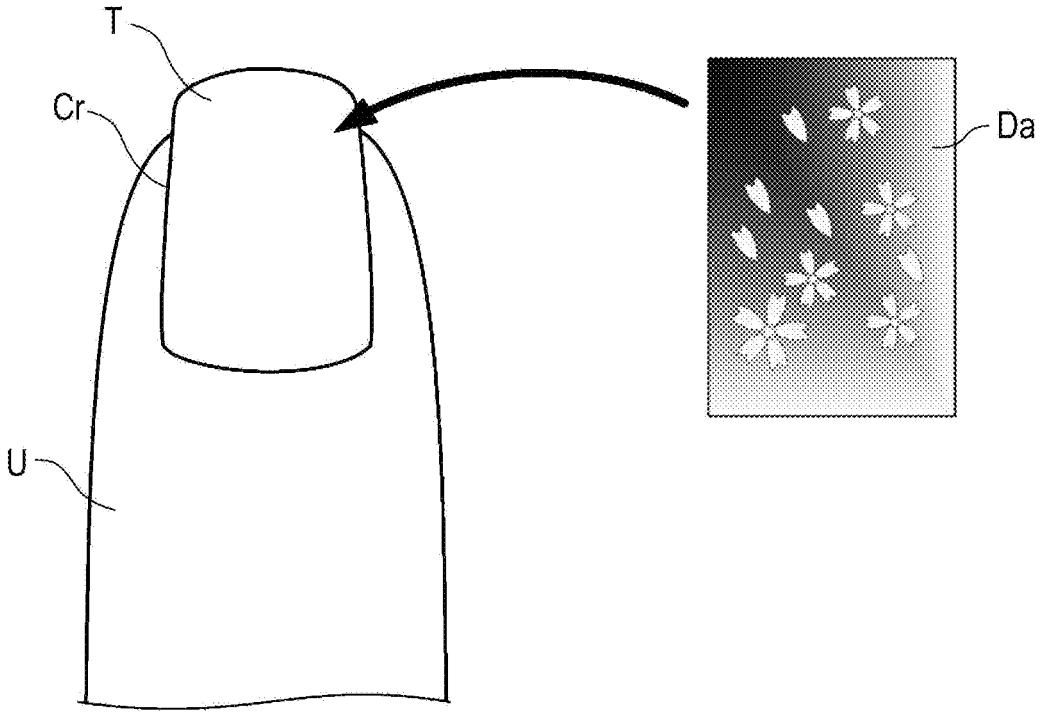
FIG. 5 is an explanatory diagram illustrating a manner in which a nail design for an entire nail is fitted to a nail area.
Figure 6A:
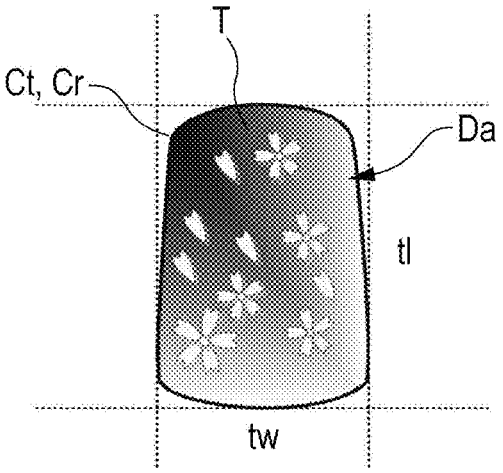
FIG. 6A is a diagram illustrating an example in which a nail design for an entire nail is fitted to a nail.
Figure 6B:
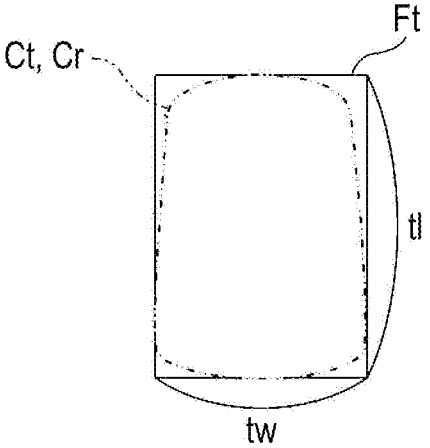
FIG. 6B is a diagram illustrating an example of a circumscribed rectangle of a nail design in which a nail design for an entire nail is fitted.

At this time, as illustrated in FIG. 5, the control device 80 fits the nail design Da with the nail T that the user wants to print, and as illustrated in FIG. 6A, the size, direction, and the like may be adjusted by the user such that the nail design Da is placed on the entire nail.

In addition, the nail information detection unit 812 sets a circumscribed rectangle (a circumscribed rectangle Ft in FIG. 6B and the like, and a part of the nail T where the nail design Da is disposed is shown by a two-dot chain line in FIG. 6B and the like.) that contacts the outer periphery (outline of nail T) of the area (area to be printed) where the nail design Da is disposed. Then, the length (width) in the nail width direction of the circumscribed rectangle Ft is denoted by "tw", the length in the vertical direction (vertical length) orthogonal thereto is denoted by "tl", and the each value is detected.

In addition, when printing is performed only on a part of the nail T (for example, when the nail design Df selected by a user is a French nail in which printing is performed only on a nail tip), the nail information detection unit 812 detects the outline of the area to be printed of the nail area on which the nail design Df is applied, as the print outline Cd.

Figure 7:
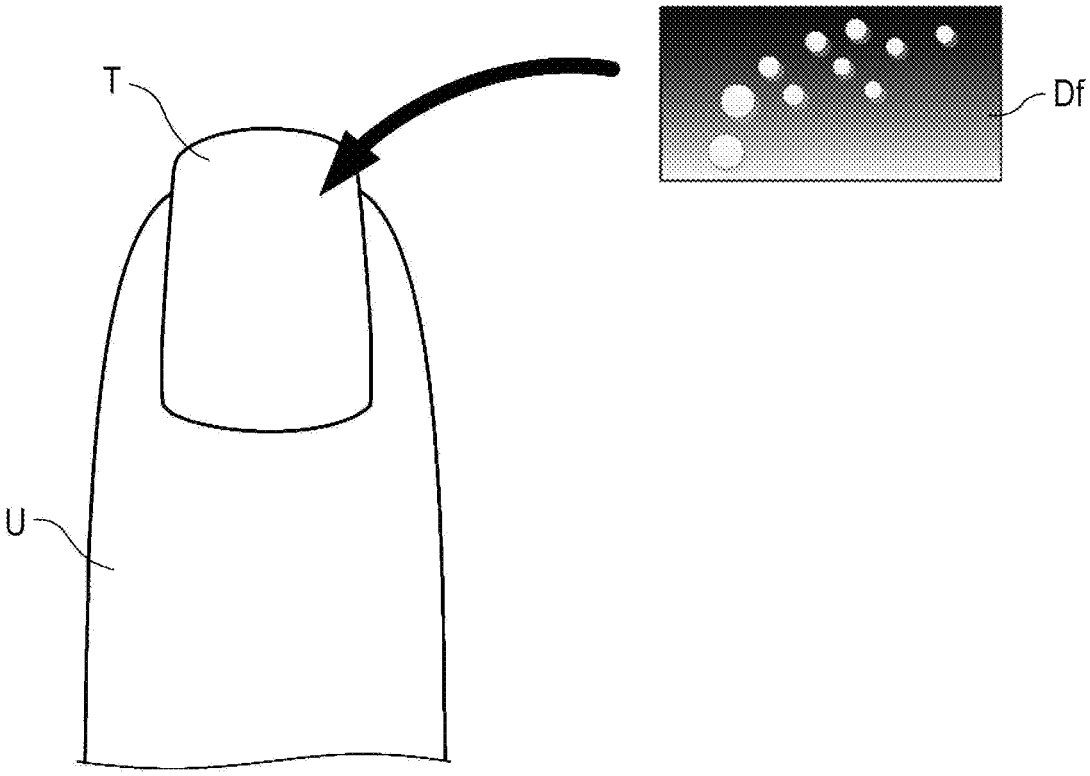
FIG. 7 is a diagram explaining a manner in which a nail design for a part of a nail is fitted to a nail area.

In this case, when the user selects the nail design Df for a French nail as the nail design to be applied to the nail T, as illustrated in FIG. 7, first the control device 80 fits the nail design Df with the nail T that the user wants to print, and the user adjusts the size, direction, and the like.

Figure 8A:
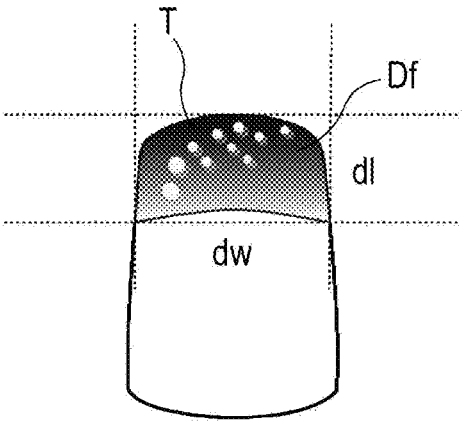
FIG. 8A is a diagram illustrating an example in which a nail design for a part of a nail is fitted to a nail tip portion.

Specifically, the nail design Df is fitted from the tip side of the user's nail T, as illustrated in FIG. 8A, the outline of the nail design Df when the nail is disposed such that there is no gap on the tip side is detected as the print outline Cd.

In addition, the nail information detection unit 812 sets a circumscribed rectangle (a circumscribed rectangle Fd in FIG. 8B and the like, and a part of the nail T where the nail design Df is disposed is shown by a two-dot chain line in FIG. 8B and the like.) that contacts the outer periphery (outline of the nail design Df fitted to the nail T) of the area (area to be printed) where the nail design Df is disposed. Then, the length (width) in the nail width direction of the circumscribed rectangle Fd is denoted by "dw", the length in the vertical direction (vertical length) orthogonal there to is denoted by "dl", and each value is detected.

In addition, the nail information detection unit 812 of the present embodiment detects the base outline Cb, which is the base outline of the print target area at the time of printing, as the outline detection unit.

For example, when the base is applied to the nail T, the base outline of the print target area is the outline of the base area B on the surface of the nail T where the base is applied.

Figure 9A:
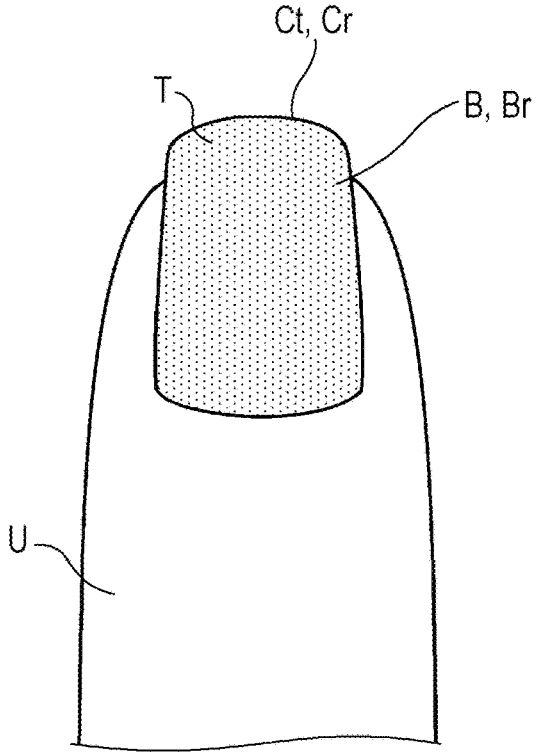
FIG. 9A is a diagram illustrating an example of a nail image showing a state in which a base has been correctly applied to an entire nail.
Figure 11A:
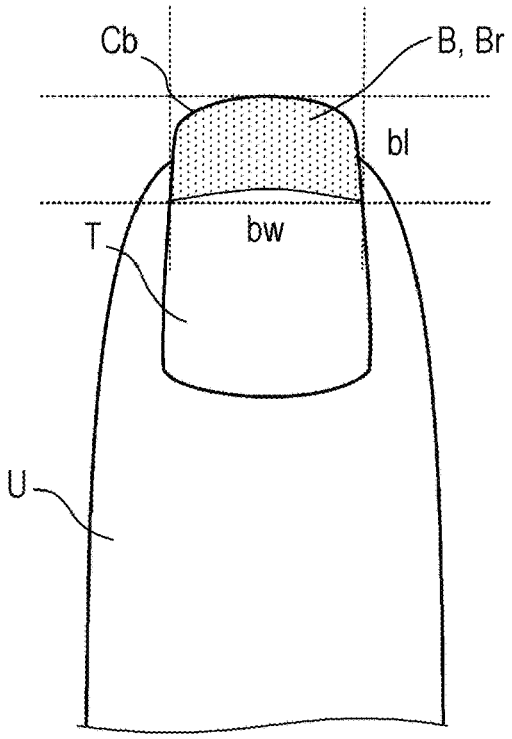
FIG. 11A is a diagram illustrating an example of a nail image when a base is correctly applied to an area to be printed where a nail design for a part of a nail is printed.

To improve the color development when printing is performed on the nail T, in the present embodiment, before printing, white or near-color ink is applied as a base to the area to be printed (that is, the entire nail when the nail design for an entire nail Da is applied, and the portion where the nail design for a part of a nail Df is set, such as the tip of the nail when the nail design for a part of a nail Df is applied) (refer to FIGS. 9A, 11A, and the like). The method of applying the base is not particularly limited, but is manually performed by, for example, a user using a pen or a brush.

Since the nail T is a color close to the surrounding skin etc., it is difficult to detect even if the nail image is analyzed as it is, but by applying a white base or the like to the nail T, the nail T can be easily distinguished from the surroundings. For this reason, in the state where a base is applied, by detecting the base outline Cb of the print target area at the time of printing, it is possible to improve the detection accuracy of the nail area.

Figure 9B:
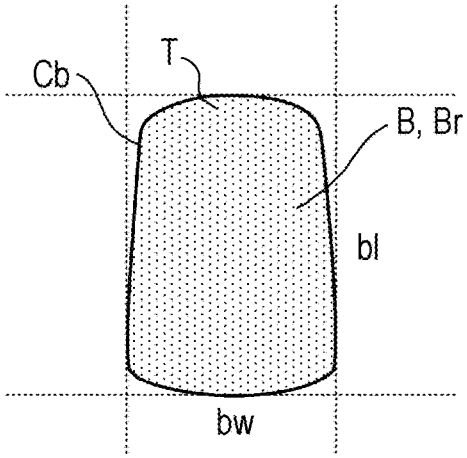
FIG. 9B is a diagram illustrating an example of an outline of a base area detected from the nail image of FIG. 9A.

However, as described above, since the base is manually applied by the user, as illustrated in FIGS. 9A and 9B (when the nail design for an entire nail Da is applied) and FIG. 11A (when the nail design for a part of a nail Df is applied), the base is not always correctly applied in the area to be printed without any excess or shortage.

Figure 10A:
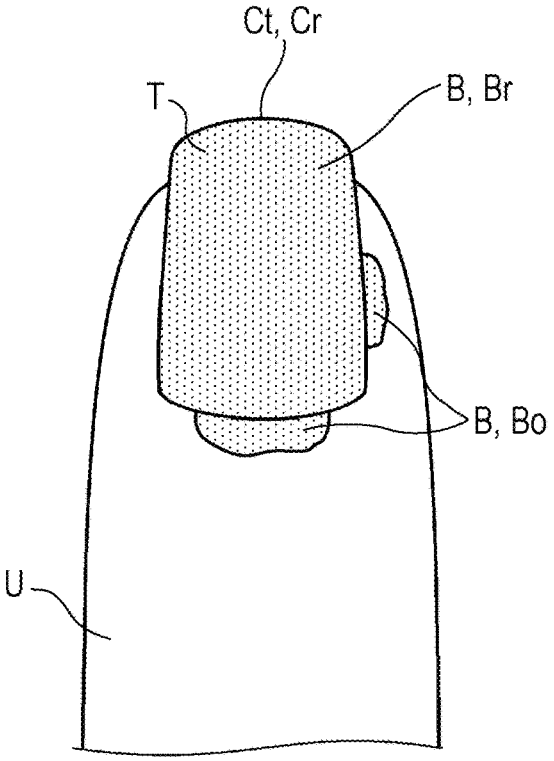
FIG. 10A is a diagram illustrating an example of a nail image showing a state in which a base is applied to a portion protruding from a nail.
Figure 10B:
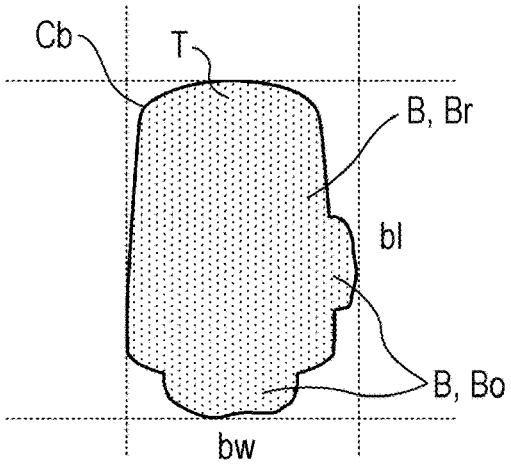
FIG. 10B is a diagram illustrating an example of an outline of a base area detected from the nail image of FIG. 10A.

For example, when it is desired to apply the nail design for an entire nail Da to the entire area of the nail T, as illustrated in FIGS. 10A and 10B, in addition to the correct base area B (Br), there is a case where a protruding area Bo is provided where a base is protruded to a non-print target that is in the vertical direction (that is, the direction of the root of the nail T) or the horizontal direction of the nail T.

In this case, the nail information detection unit 812 as the outline detection unit detects the outline of the base area B combining the correct base area B (Br) and the protruding area Bo as the base outline Cb (refer to FIG. 10B).

Figure 11B:
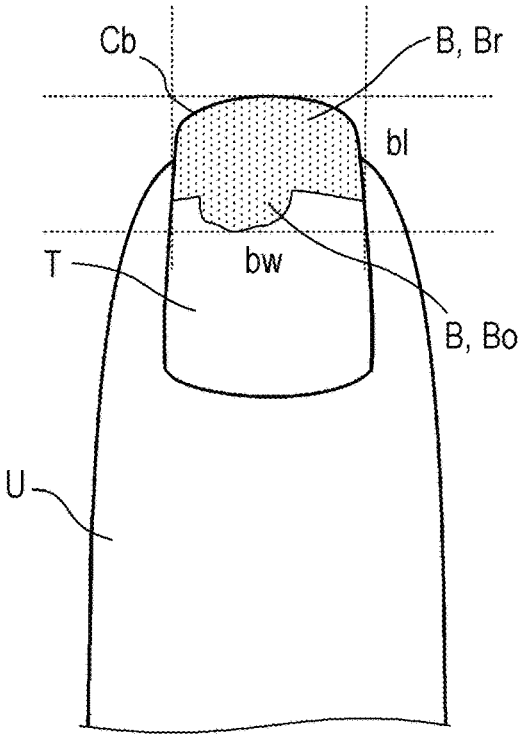
FIG. 11B is a diagram illustrating an example of a nail image when a base is applied up to a portion protruding from an area to be printed.

Further, for example, when it is desired to apply the nail design for a part of a nail Df to a part of the nail T, as illustrated in FIG. 11B, in addition to the correct base area B (Br), there is a case where a protruding area Bo is provided where a base is protruded in the vertical direction (that is, the root direction of the nail T) or the like.

In this case, the nail information detection unit 812 as the outline detection unit detects the outline of base area B combining the correct base area B (Br) and the protruding area B (Bo) as the base outline Cb.

Figure 11C:
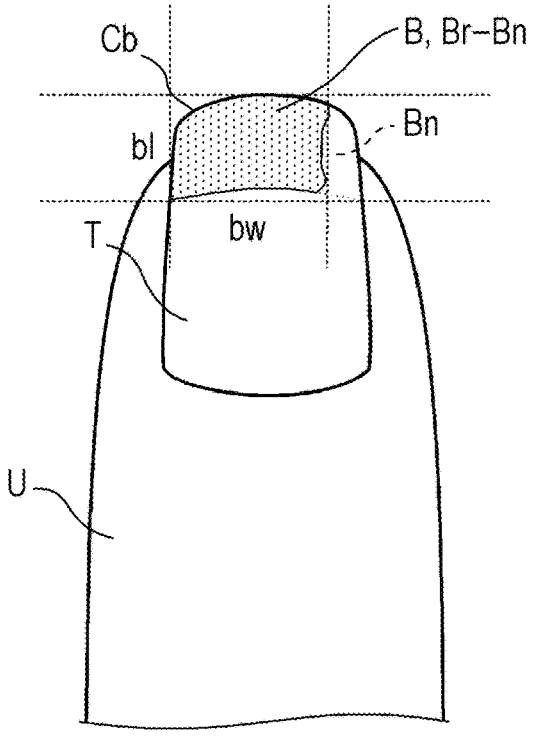
FIG. 11C is a diagram illustrating an example of a nail image when a base is applied without painting a part of an area to be printed.

Conversely, as illustrated in FIG. 11C, if the nail T has an unpainted area Bn in part, the nail information detection unit 812 as an outline detection unit, as compared with the base area B (Br) when the base is correctly applied as illustrated in FIG. 11A, detects the outline of the narrow base area B (that is, the Br-Bn area) as the base outline Cb.

Further, even when the base is correctly applied only to the correct base area B (Br), the nail information detection unit 812 may erroneously recognize the base area B when the base area B is detected from the nail image.

As a cause of erroneous recognition by the nail information detection unit 812, it is conceivable that, for example, since a base is white, when the photographing unit 50 photographs the nail T (the finger U including the nail T), the light of the lighting device 52 is reflected on the surface of the nail T and the like, such that a wider area than the actual area shines white, and the nail information detection unit 812 recognizes a portion that appears white due to reflection as the base area B.

In this case, the outline of the base area B that has been erroneously recognized more widely than the actual area is detected as the base outline Cb. In the present embodiment, regardless of whether the base outline Cb is almost equal to the print outlines Ct and Cd, a state in which a base such as a white base is applied to the nail T is a state in which printing is ready.

The outline comparison determination unit 813 compares the print outline Ct (registered outline Cr) or the print outline Cd, based on the nail design Da or nail design Df and the base outline Cb detected by the nail information detection unit 812, which is an outline detection unit, to determine whether there is a difference equal to or larger than a set value.

In the present embodiment, the outline comparison determination unit 813 compares the vertical lengths tl and dl and the horizontal widths tw and dw of the circumscribed rectangles Ft and Fd set to the print outlines Ct and Cd, and the vertical length bl and the horizontal width bw of the circumscribed rectangle Fb set to the outline of the base area that is the base outline Cb. If any one of the vertical length bl and the horizontal width bw of the outline of the base area (base outline Cb) is larger by a set value or more, it is determined that the difference is equal to or larger than the set value.

Note that the circumscribed rectangles Ft and Fd may be set by the nail information detection unit 812, or may be set by the outline comparison determination unit 813 based on the outline detected by the nail information detection unit 812.

Figure 12:
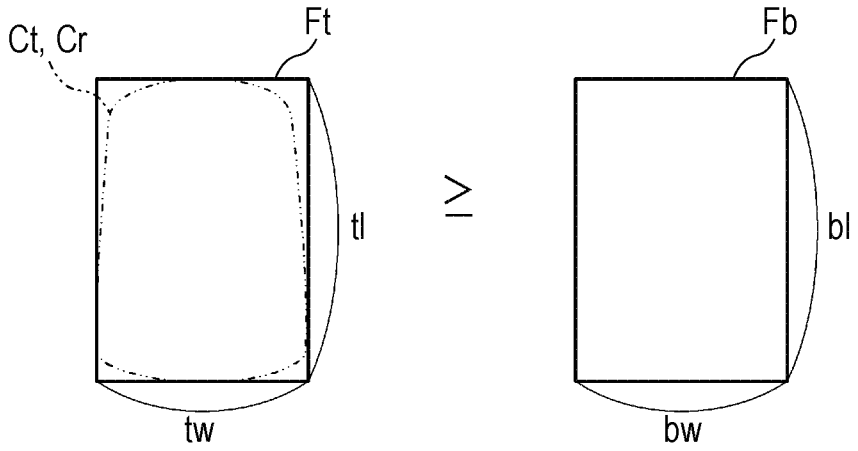
FIG. 12 is a diagram illustrating the case where, when a comparison is made between a print outline and a base outline in the case of applying a nail design for an entire nail to a nail, both are equal, or the latter is smaller.

That is, when it is desired to apply the nail design for an entire nail Da to the entire area of the nail T, as illustrated in FIG. 12, comparisons are made between the vertical length tl of the circumscribed rectangle Ft set to the print outline Ct that is the outline of the nail T (that is, the registered outline Cr) and the vertical length bl of the circumscribed rectangle Fb set to the base outline Cb and between the horizontal width tw of the circumscribed rectangle Ft and the horizontal width bw of the circumscribed rectangle Fb. Then, when both the vertical length bl and the horizontal width bw are equal to or smaller than the vertical length tl and the horizontal width tw, the outline comparison determination unit 813 determines that the difference is smaller than the set value. It should be noted that even when one of the vertical length bl and the horizontal width bw is smaller than the vertical length tl and the horizontal width tw by the set value or more, it may be determined that there is a difference equal to or larger than the set value.

Figure 13:
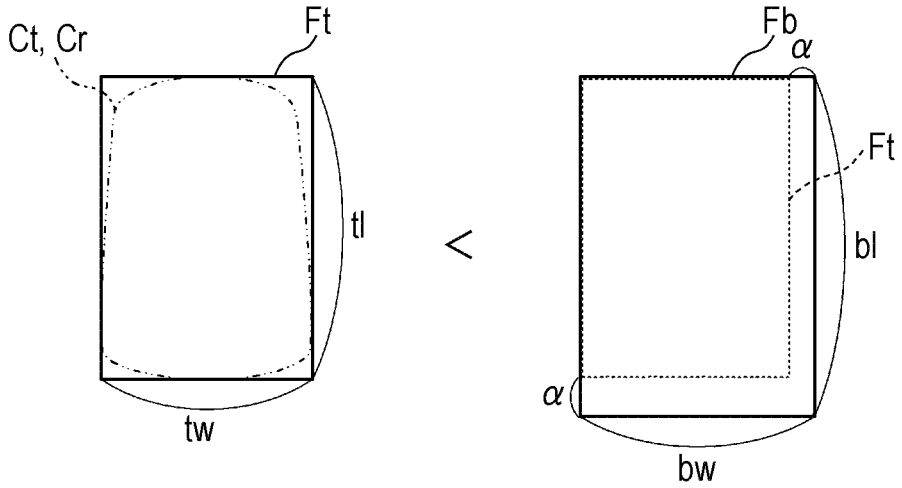
FIG. 13 is a diagram illustrating the case where, when a comparison is made between a print outline and a base outline in the case of applying a nail design for an entire nail to a nail, the latter is larger.

On the other hand, as illustrated in FIG. 13, when any one of the vertical length bl and the horizontal width bw is larger than the vertical length tl and the horizontal width tw by the set value or more, it is determined that there is a difference equal to or larger than the set value.

In FIG. 13, the difference is represented by "a", and a case is shown in which both the vertical length bl and the horizontal width bw differ by "a".

When the outline comparison determination unit 813 determines that the difference is smaller than the set value (that is, in the present embodiment, both the vertical length bl and the horizontal width bw are equal to or smaller than the vertical length tl and the horizontal width tw), as illustrated in FIG. 5, the desired nail design Da can be printed on the nail T without an ink protruding from the finger U by performing printing while fitting the nail design Da for an entire nail with the base outline Cb of the entire nail T.

Figure 14:
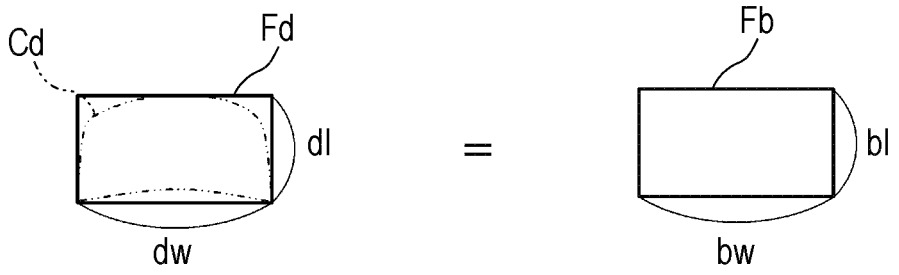
FIG. 14 is a diagram illustrating the case where, when a comparison is mad between a print outline and a base outline in the case of applying a nail design for a part of a nail to a nail, both are equal.

In addition, when it is desired to print the nail design for a part of a nail Df on a part of the nail T, as illustrated in FIG. 14, comparisons are made between the vertical length dl of the circumscribed rectangle Fd set to the print outline Cd, which is the outline of the nail design Df and the vertical length bl of the circumscribed rectangle Fb set to the base outline Cb and between the horizontal width dw of the circumscribed rectangle Fd and the horizontal width bw of the circumscribed rectangle Fb each other. If both the vertical length bl and the horizontal width bw are the same as the vertical length dl and the horizontal width dw respectively, the outline comparison determination unit 813 determines that the difference is smaller than a set value (the two are almost the same).

Figure 15:
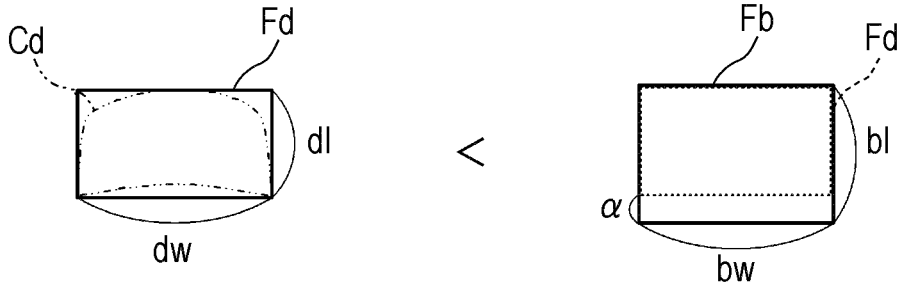
FIG. 15 is a diagram illustrating the case where, when a comparison is made between a print outline and a base outline in the case of applying a nail design for a part of a nail to a nail, the latter is larger.

On the other hand, as illustrated in FIG. 15, when the vertical length bl (or the horizontal width bw) is larger than the vertical length dl (or the horizontal width dw) by the set value or more, it is determined that the difference is equal to or more than the set value.

Figure 16:
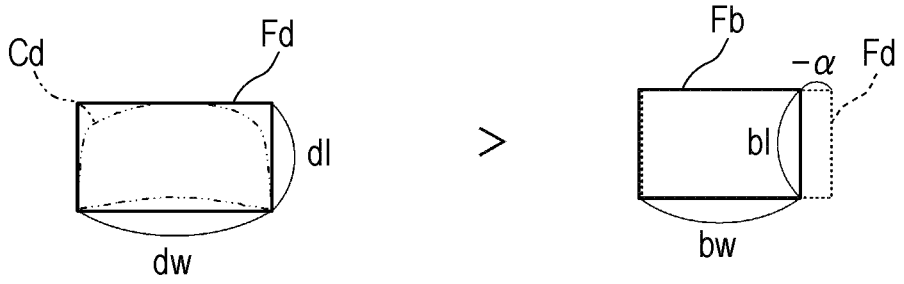
FIG. 16 is a diagram illustrating the case where, when a comparison is made between a print outline and a base outline in the case of applying a nail design for a part of a nail to a nail, the latter is smaller.

Further, as illustrated in FIG. 16, even when the horizontal width bw (or the vertical length bl) is smaller than the horizontal width dw (or the vertical length dl) by the set value or more, it is determined that the difference (the absolute value of the difference) is equal to or larger than the set value.

When the outline comparison determination unit 813 determines that the difference is smaller than the set value, as illustrated in FIG. 8A, by printing while fitting the nail design Df with the base outline Cb, the desired nail design Df can be printed in a predetermined area of the nail T (for example, in the case of a French nail, the area of a nail tip) such that the nail design Df fits in the area where a base is applied.

FIG. 15 illustrates the case where when the vertical length bl (or horizontal width bw) of the circumscribed rectangle Fb set in the base outline Cb is larger than the vertical length dl (or the horizontal width dw) of the circumscribed rectangle Fd set in the print outline Cd, the difference between the two is represented by "a", and only the vertical length bl has a difference of "a".

Further, FIG. 16 illustrates the case where when the horizontal width bw (or vertical length bl) of the circumscribed rectangle Fb set in the base outline Cb is smaller than the horizontal width dw (or the vertical length dl) of the circumscribed rectangle Fd set in the print outline Cd, the difference between the two is represented by "α", and only the horizontal width bw has a difference of "α".

Here, the value of the "set value" is appropriately set, and is, for example, about 0.5 to 1 mm. When printing is performed on the nail T and if the base area B protrudes from about 0.5 to 1 mm, the ink stains attached to the finger U (skin of the finger U) around the nail T when printing on the area cannot be ignored. Note that, depending on the size and shape of the nail T, even if the base area B protrudes by 1 mm or more, it may not be noticeable. For this reason, the "set value" may be set such that the user or the like can adjust or change it afterwards even if the "set value" is set to about 0.5 to 1 mm as a default.

In addition, for example, the "set value" of the difference a of the horizontal width bw is set to 0.3 mm, the "set value" of the difference a of the vertical length bl is set to 0.8 mm, and the allowable "set value" may be changed vertically and horizontally depending on how noticeable the protrusion is.

Further, the allowable "set value" may be changed between the case where the nail design for an entire nail Da is applied to the entire nail T (refer to FIGS. 12 and 13) and the case where the nail design for a part of a nail Df is applied to a part of the nail T (refer to FIGS. 14 to 16).

The method by which the outline comparison determination unit 813 compares the print outlines Ct and Cd and the base outline Cb is not limited to the above-described method.

For example, the outline comparison determination unit 813 may compare the aspect ratios of the vertical length bl and the horizontal width bw of the circumscribed rectangles Ft and Fd set to the print outlines Ct and Cd and the circumscribed rectangle Fb set to the outline of the base area which is the base outline Cb, and may determine that the difference is equal to or larger than the set value when the aspect ratios of the two differ by the set value or more.

If the aspect ratio is significantly different, the nail information detection unit 812 may have failed to recognize the base outline Cb after applying the base, and if printing is performed as it is, printing may not be performed in the correct range. In the "set value" in this case, for example, the degree of difference when the aspect ratio of the circumscribed rectangle Fb set for the base outline Cb (vertical length bl for the horizontal width bw) and the aspect ratio of the circumscribed rectangles Ft and Fd set in the print outlines Ct and Cd (vertical lengths tl and dl for horizontal widths tw and dw) are compared is about 10%. In this case as well, the "set value" may be adjusted or changed by the user or the like afterwards even if the "set value" is set to about 10% as a default.

The print data generation unit 814 generates data for printing performed on the nail T by the printing head 41 based on nail information detected by the nail information detection unit 812.

In the present embodiment, the print data generation unit 814 sets a printing area based on the determination result by the outline comparison determination unit 813. That is, the print data generation unit 814 compares the print outlines Ct and Cd and the base outline Cb by the outline comparison determination unit 813, and when it is determined that there is no difference equal to or larger than the set value as a result, the area within the base outline Cb is set as a printing area. Then, the print data generation unit 814 generates print data so as to match the printing area.

Specifically, the print data generation unit 814 performs a fitting process for fitting to the shape of the nail T by enlarging, reducing, clipping and the like of nail design image data based on the base outline Cb detected by the nail information detection unit 812.

Further, the print data generation unit 814 performs appropriate correction and generates print data to be printed on the surface of the nail T, which is the print target surface.

Further, when the nail information detection unit 812 has obtained the curvature and the like of the nail T, the print data generation unit 814 may appropriately perform a curved surface correction such as, for example, an adjustment of the density such that the print density at both ends of the nail T does not decrease in accordance with the curvature of the nail T.

The print control unit 815 is a control unit which outputs a control signal to the printing unit 40 based on print data generated by the print data generation unit 814 and controls the X direction moving motor 46, the Y direction moving motor 48, the printing head 41 and the like of the printing unit 40 so as to perform printing to the nail T according to the print data.

The display control unit 816 controls the display unit 23 to cause to display various display images.

In the present embodiment, by the display control unit 816, for example, a nail image obtained by photographing the finger U, a design selection screen for selecting an image to be printed on the nail T (that is, "nail design"), a thumbnail image for design confirmation, an instruction screen for displaying various instructions, and the like are displayed on the display unit 23.

In the present embodiment, when the difference determined by the outline comparison determination unit 813 is equal to or larger than the set value, the display control unit 816 causes the display unit 23 to display a notification screen, a warning screen, and the like, for notifying the user that the nail design may not be printed correctly if it is printed in the current base area (that is, within the range of the base outline Cb), to cause the display unit 23 to function as notification means.

Further, when the difference determined by the outline comparison determination unit 813 is equal to or more than the set value, the display control unit 816 may control the display unit 23, so as to display a display screen that prompts the user to correct the base outline Cb, a nail outline correction screen for correcting the recognition result by the nail information detection unit 812, and the like.

Next, a printing method by the nail printer 1 which is the printer according to the present embodiment will be described with reference to FIGS. 17 to 19.

In the present embodiment, first, the user sets the finger U on the finger fixing mechanism 3 of the nail printer 1 in advance, and performs photographing of the finger U by the photographing unit 50. Thus, as illustrated in FIG. 17, a nail image is obtained (step S1).

At this time, the fingers U of the right and left hands may be sequentially set, and all the ten fingers of both hands are photographed to obtain nail images of the fingers U. In this case, a notification screen or the like prompting the user to sequentially set the finger U to the set position may be displayed on the display unit 23 or the like.

For example, when a nail image as illustrated in FIG. 4 is obtained, the nail information detection unit 812 detects the outline of the nail area (refer to FIG. 7) and stores the outline as the registered outline Cr in the storage unit 82 (step S2).

At this time, confirmation of the detection result by the user may be requested by, for example, superimposing the outline as the detection result on the nail image and displaying it on the display unit 23. Further, when it is desired to manually correct the detection result, the correction may be appropriately performed by tracing a correct outline on the display screen of the display unit 23 with a pen or the like. In this case, the data is updated such that the corrected outline is used as the registered outline Cr.

When the outline is manually corrected, the outline may not be smooth due to hand shake or the like. For this reason, it is preferable to perform the correction such that outline s are smoothly connected by performing edge smoothing processing to which various types of smoothing filters are appropriately applied. Various filters such as a moving average filter, a weighted average filter, and a Gaussian filter can be applied as the smoothing filter.

Further, the display control unit 816 causes the display unit 23 to display a design selection screen, the user operates operation buttons of the operation unit 22, the touch panel 222, and the like, and selects a desired nail design from a plurality of nail designs displayed on the design selection screen. As a result, a selection instruction signal is output from the operation unit 22, and one nail design is selected as the nail design to be printed on the nail T (step S3).

Thus, preparations before printing are completed. This advance preparation may be performed immediately before actually performing the nail print, may be performed several days ago, several months ago, or the like, and is performed at an arbitrary timing of the user.

When printing is performed by the nail printer 1, the control device 80 first determines whether or not the selected nail design is for an entire nail (step S4).

If the nail design is for an entire nail (step S4; YES), the printing process is performed in the design mode for an entire nail (step S5, refer to FIG. 18). On the other hand, if the nail design is not for an entire nail (step S4; NO), the printing process is performed in the design mode for a part of a nail (step S6, refer to FIG. 19).

First, the printing process (step S5 in FIG. 17) in the design mode for an entire nail is performed as follows.

That is, in this case, the user sets the finger U on the finger fixing mechanism 3 after applying the base to the entire nail T. When the nail design Da for the entire nail is selected, an instruction screen for prompting the user to apply the base to the entire nail T and to set the finger U may be displayed on the display unit 23.

Figure 18:
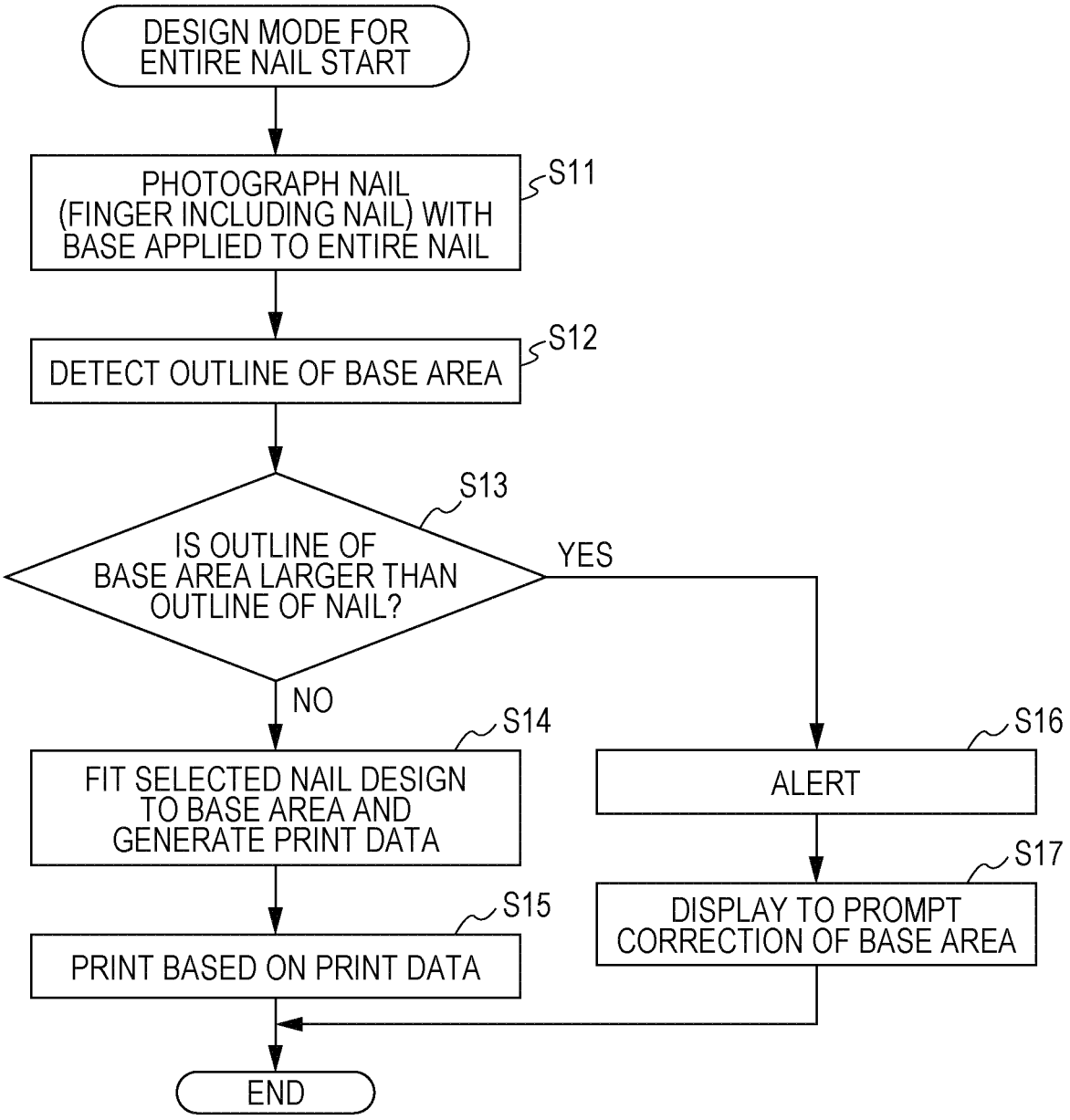
FIG. 18 is a flowchart illustrating the case of printing a nail design for an entire nail in the printing method according to the embodiment.

When the finger U is set, as illustrated in FIG. 18, the nail T (the finger U including the nail T) having the base applied to the entire nail T is photographed by the photographing unit 50, for example, to obtain a nail image as illustrated in FIGS. 9A and 10A (step S11).

Then, the nail information detection unit 812 detects the outline of the base area B on which the base is applied as the base outline Cb from the nail image (step S12, refer to FIGS. 9B and 10B).

The outline comparison determination unit 813 reads the registered outline Cr, which is the print outline Ct in the design mode for an entire nail from the nail information storage region 822 of the storage unit 82, and compares this registered outline Cr with the base area B as the base outline Cb detected by the nail information detection unit 812, and the outline comparison determination unit 813 determines whether or not the base outline Cb is smaller than the print outline Ct (step S13).

In the present embodiment, a circumscribed rectangle (that is, the circumscribed rectangle Ft of the print outline Ct in FIGS. 12 and 13 and the circumscribed rectangle Fb of the base outline Cb in FIGS. 12 and 13) is set for each of the print outline Ct and the base outline Cb, and the outline comparison determination unit 813 determines the size of the print outline Ct and the base outline Cb by comparing the horizontal widths tw and bw and the vertical lengths tl and bl of the circumscribed rectangles Ft and Fb.

If the base outline Cb is not larger than the print outline Ct, that is, in the present embodiment, if the base outline Cb is equal to or smaller than the print outline Ct (step S13; NO), the print data generation unit 814 generates the print data after fitting the selected nail design for an entire nail Da within the range of the base outline Cb, that is, the base area B, and appropriately performing curved surface correction and the like (step S14). Then, the print control unit 815 outputs the print data to the printing unit 40, and printing based on the print data is performed (step S15).

On the other hand, if the base outline Cb (the circumscribed rectangle Fb of the base outline Cb) is larger than the print outline Ct (the circumscribed rectangle Ft of the print outline Ct) (step S13; YES), an alert is displayed on the display unit 23 or the like, to notify the user (step S16).

The method of displaying the alert is not particularly limited, but may be, for example, displayed using characters, or the print outline Ct and the base outline Cb may be displayed in a superimposed manner to indicate a part where the two coincide with each other, a portion protruding from the outline, and the like. In the case of displaying in the superimposed manner, it is preferable that the protruding portion be presented to the user in an easy-to-understand manner by coloring it or the like.

Note that the alert is not limited to the display. For example, a lamp (not illustrated) may be turned on or blinked, or when a speaker (not illustrated) is provided, voice guidance may be performed.

In addition, as a result of performing the alert, if the user approves the determination result by the outline comparison determination unit 813, regardless of whether to protrude, print data may be generated and printed using the base outline Cb as a printing area.

In addition, except when the base outline Cb is substantially equal to the print outline Ct, that is, not only when the base outline Cb is larger than the print outline Ct by a predetermined value (set value) or more (when protruding), but also when the base outline Cb is smaller than the print outline Ct by a predetermined value (set value) or more (when there is unpainted area), an alert may be displayed on the display unit 23 or the like, and the user may be notified. If there is an unpainted portion, the base outline Cb is corrected by adding the base or the like such that the base outline Cb becomes substantially the same as the print outline Ct. In this case, the nail T after the correction may be photographed again to obtain a nail image, and the base outline Cb may be detected again.

When the alert is issued, a display prompting the user to correct the outline of the base area B, which is the base outline Cb, may be displayed on the display unit 23 (step S17). For example, if it is determined due to erroneous recognition of the base area B and the like that the base outline Cb (the circumscribed rectangle Fb of the base outline Cb) is larger than the print outline Ct (the circumscribed rectangle Ft of the print outline Ct), the user may be allowed to manually correct the base outline Cb. In this case, the correct outline of the base area B is appropriately corrected, for example, by tracing with a pen on the display screen of the display unit 23. When the base outline Cb is corrected, the data is updated such that the corrected outline is used as the base outline Cb.

It is noted that, in this case, it is preferable that the outline corrected manually is subjected to edge smoothing processing to which various types of smoothing filters are applied as appropriate, such that the outline is corrected to be smoothly connected.

On the other hand, if it is determined due to failure (protrusion) of the base application by a user that the base outline Cb (the circumscribed rectangle Fb of the base outline Cb) is larger than the print outline Ct (the circumscribed rectangle Ft of the print outline Ct), correction is made such that the base outline Cb is almost the same as the correct base area B by once removing the finger U from the finger fixing mechanism 3 and removing the base protruding area B (Bo, refer to FIG. 10B) with a remover or the like. In this case, the nail T after the correction may be photographed again to obtain a nail image, and the outline of the base area B (base outline Cb) may be detected again. Alternatively, print data may be generated and printed by using a portion where the print outline Ct and the base outline Cb overlap as a printing area.

On the other hand, the printing process (step S6 in FIG. 17) in the design mode for a part of a nail is performed as follows.

Figure 17:
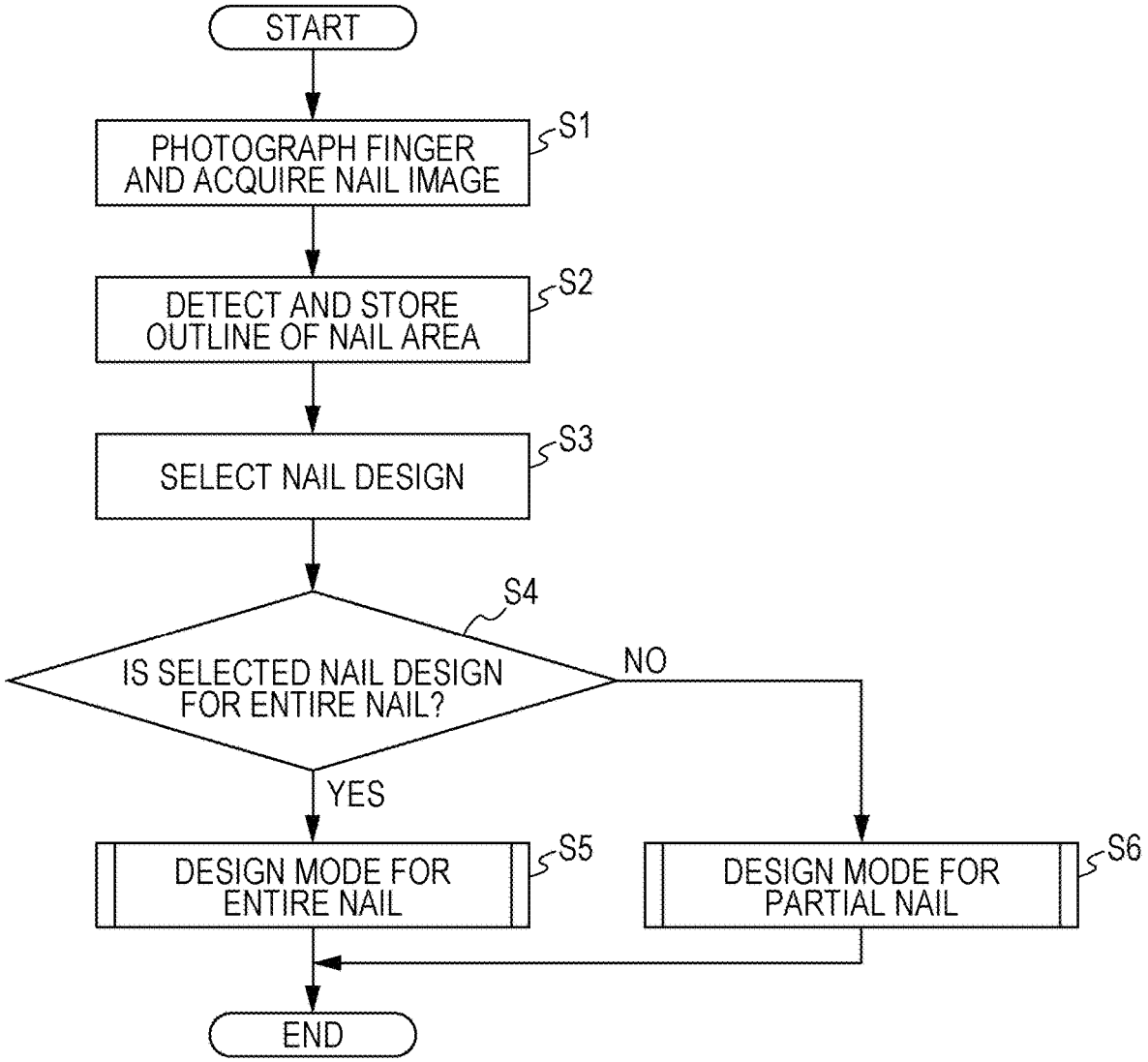
FIG. 17 is a flowchart illustrating an outline of a printing method according to the embodiment.
Figure 19:
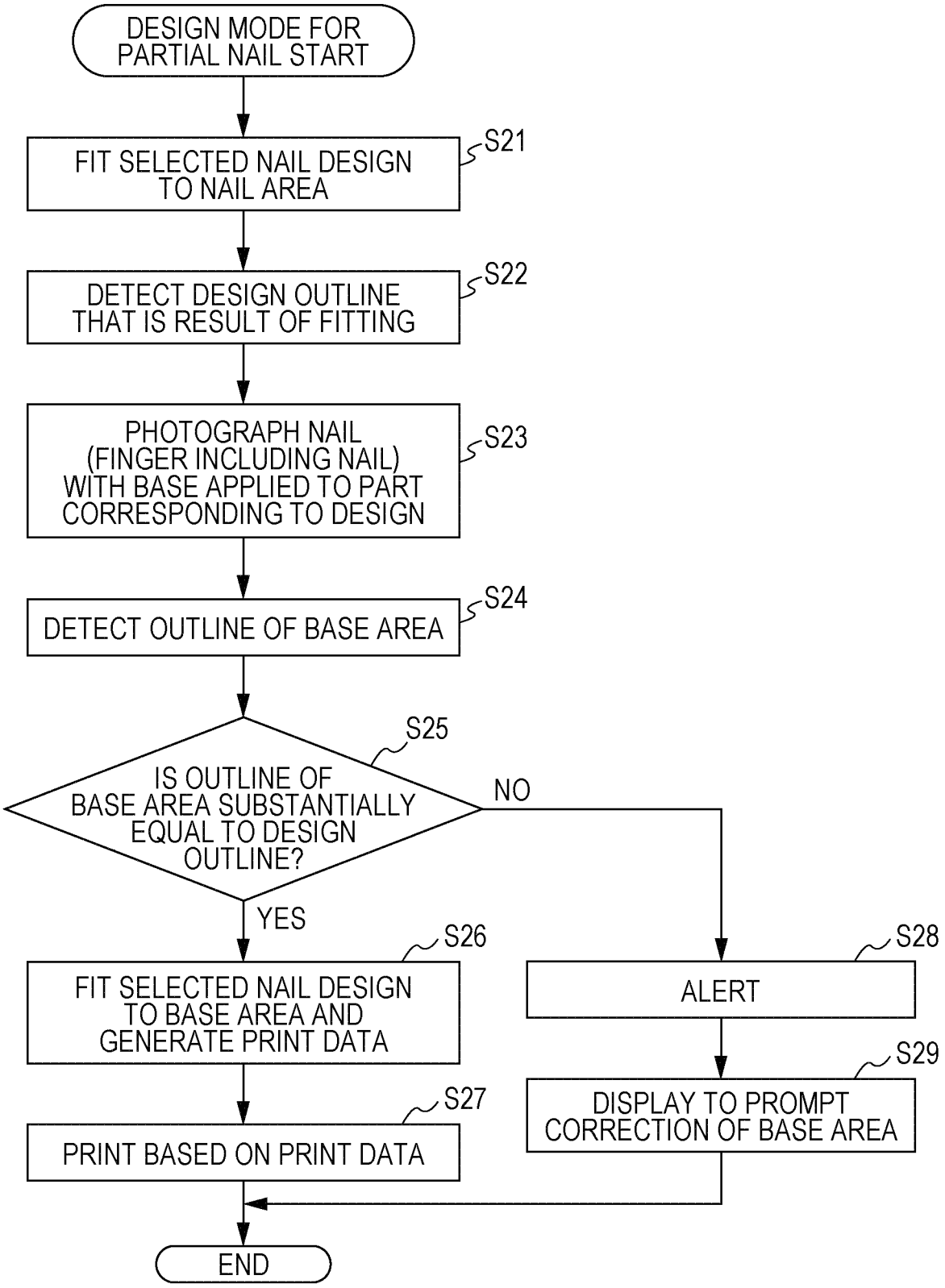
FIG. 19 is a flowchart illustrating the case of printing a nail design for a part of a nail in the printing method according to the embodiment.

That is, in this case, as illustrated in FIG. 19, the control device 80 fits, for example, the nail design Df for the selected portion in the outline (registered outline Cr) of the nail area detected in step S2 of FIG. 17 (step S21, refer to FIG. 7).

Figure 8B:
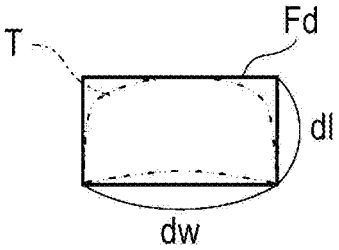
FIG. 8B is a diagram illustrating an example of a circumscribed rectangle of a nail design in which a nail design for a part of a nail is fitted.

Then, as illustrated in FIGS. 8A and 8B, the outline of the nail design Df, which is the result of the fitting, is detected as the print outline Cd (step S22).

The user sets the finger U on the finger fixing mechanism 3 after applying a base to an area corresponding to the print outline Cd on which the nail design Df is disposed, such as a nail tip portion. Note that an instruction screen for urging the user to apply a base to a nail tip portion or the like and to set the finger U may be displayed on the display unit 23.

When the finger U is set, the nail T (the finger U including the nail T) having a base applied to a part of the nail, such as a nail tip portion, is photographed by the photographing unit 50, and, for example, to obtain a nail image as illustrated in FIGS. 11A to 11C (step S23).

Then, the nail information detection unit 812 detects the outline of the base area B on which the base is applied from the nail image as the base outline Cb (step S24).

The outline comparison determination unit 813 compares the print outline Cd with the base area B as the base outline Cb detected by the nail information detection unit 812, and determines whether the base outline Cb is substantially equal to the print outline Cd, that is, whether there is no difference, and whether the difference is within the set value even if there is a difference (step S25).

When the base outline Cb is substantially equal to the print outline Cd (step S25; YES, refer to FIG. 14), the print data generation unit 814 fits the nail design Df for the selected part within the range of the base outline Cb, that is, the base area B, and generates print data after appropriately performing curved surface correction and the like (step S26). Then, the print control unit 815 outputs the print data to the printing unit 40, and printing based on the print data is performed (step S27).

On the other hand, if the base outline Cb (the circumscribed rectangle Fb of the base outline Cb) has a difference equal to or more than the set value when compared with the print outline Cd (the circumscribed rectangle Fd of the print outline Cd) (step S25; NO), that is, as illustrated in FIG. 15, when the base outline Cb (the circumscribed rectangle Fb of the base outline Cb) is equal to or larger than the set value, or as illustrated in FIG. 16, when the base outline Cb (the circumscribed rectangle Fb of the base outline Cb) is smaller by the set value or more, an alert is displayed on the display unit 23 or the like, to notify the user (step S28). Note that the manner of displaying the alert and the method of alert notification are not particularly limited, as in the case of the design mode for an entire nail.

When an alert is issued, a display prompting the user to correct the outline of the base area B, which is the base outline Cb, may be displayed on the display unit 23, as in the case of the entire design mode (step S29). For example, if it is determined due to erroneous recognition of the base area B and the like that the base outline Cb (the circumscribed rectangle Fb of the base outline Cb) is larger or smaller than the print outline Cd (the circumscribed rectangle Fd of the print outline Cd), the user may be allowed to manually correct the base outline Cb. In this case, the correct outline of the base area B is appropriately corrected, for example, by tracing with a pen on the display screen of the display unit 23. When the base outline Cb is corrected, the data is updated such that the corrected outline is used as the base outline Cb.

It is noted that, in this case, it is preferable that the outline corrected manually is subjected to edge smoothing processing to which various types of smoothing filters are applied as appropriate, such that the outline is corrected to be smoothly connected.

On the other hand, if it is determined due to failure (protrusion and unpainted area) of the base application by a user that the base outline Cb (the circumscribed rectangle Fb of the base outline Cb) is larger or smaller than the print outline Cd (the circumscribed rectangle Fd of the print outline Cd), correction is made such that the base outline Cb is almost the same as the correct base area B by once removing the finger U from the finger fixing mechanism 3, removing the base protruding area B (Bo, refer to FIG. 11B) with a remover or the like, and applying a base to the unpainted area Bn. In this case, the nail T after the correction may be photographed again to obtain a nail image, and the outline of the base area B (base outline Cb) may be detected again.

As described above, in the present embodiment, if a comparison is made between the print outlines Ct and Cd and the base outline Cb (the entire nail T or a part of the nail T) after the base is applied, and the difference is equal to or larger than a set value, in order to notify the user, printing can be started as appropriate, nail printing with excellent finish can be performed.

As described above, according to the present embodiment, a comparison is made between the print outlines Ct and Cd as the outline of the area to be printed and the base outline Cb as the outline of the print target area at the time of printing, if there is a difference between the two, it is notified to the user.

For this reason, when the printing area is set in an erroneous range, the user notices before printing and can take appropriate measures. As a result, it is possible to prevent the design from being printed while the design is collapsed or protruding, and to prevent a failure in the nail print, and to perform satisfactory printing.

Further, in the present embodiment, the area to be printed is the entire surface or a part of the nail area which is the surface of the nail T, and the base outline Cb is the outline of the base area B on the surface of the nail T where the base is applied.

The nail T with the base applied is relatively easy to distinguish from the skin etc., and it is easy to accurately detect the outline. On the other hand, when the base is applied manually, the application range of the base may not be appropriate. If the application of the base has failed, when nail print is applied to the area recognized as the base area, the printing area is set up to portions that should not be printed, and there is a possibility that an ink may adhere to portions other than the nail T. In this regard, in the present embodiment, it is possible to easily confirm whether there is any deviation between the original print outlines Ct and Cd and the base area B (base outline Cb), nail print failure can be prevented.

Then, when a comparison is made between the original print outline Ct and Cd and the base area B (base outline Cb), the circumscribed rectangles Ft, Fd, and Fb are respectively set for the print outlines Ct and Cd and the base outline Cb. By comparing the vertical length and horizontal width of this circumscribed rectangles Ft, Fd, and Fb, if the outline of the base area B is larger by the set value or more in either one of the vertical length and the horizontal width, it may be determined that the difference is equal to or larger than the set value.

In this case, satisfactory nail printing can be performed while preventing printing in an erroneous range.

Further, when the circumscribed rectangles Ft, Fd, and Fb are set as described above, and the original print outlines Ct and Cd are compared with the base area B (the base outline Cb), a comparison is made between the aspect ratios of the vertical length and horizontal width of the circumscribed rectangles Ft, Fd, and Fb, and if it is determined that the difference is equal to or larger than the set value when the aspect ratios of the two differ by the set value or more, it is possible to appropriately notify the user when there is a possibility that the nail design may collapse.

For this reason, failure of nail printing can be prevented beforehand.

Further, since the determination is made by setting the circumscribed rectangles Ft, Fd, and Fb, satisfactory printing can be achieved by simpler and faster processing than when recognizing and comparing differences in the details of the outline.

Further, also in the case where the area to be printed is the area of the nail tip where the French nail is to be applied on the surface of the nail T, according to the method described in the present embodiment, it is possible to easily determine whether the base has been applied to the area corresponding to the nail design Df without excess or shortage.

For this reason, it is possible to appropriately cope with the case where the base is applied on an erroneous range before printing.

In the present embodiment, when the difference determined by the outline comparison determination unit 813 is equal to or larger by a set value or more, a display screen for prompting a user to correct the base outline is displayed on the display unit 23.

Therefore, the user can easily perform a correction operation.

Although the embodiment according to the present invention has been described above, the present invention is not limited to the embodiment and can be variously changed within the scope of the gist thereof.

For example, in the present embodiment, when the outline comparison determination unit 813 compares the original print outlines Ct and Cd with the base area B (the base outline Cb), although the circumscribed rectangles Ft, Fd, and Fb are respectively set to the print outlines Ct and Cd and the base outline Cb, the case where the circumscribed rectangles Ft, Fd, and Fb are compared with each other is exemplified, but it is not essential to set the circumscribed rectangles Ft, Fd, and Fb for the print outlines Ct and Cd and the base outline Cb.

The outline comparison determination unit 813 may compare the print outlines Ct and Cd with the base outline Cb between the outline data each other. In this case, individual points constituting the outlines of both can be compared with each other precisely by a method such as pattern matching, and it is possible to determine the difference or deviation between the print outlines Ct and Cd and the base outline Cb with higher accuracy.

When the outline comparison determination unit 813 compares the circumscribed rectangles Ft, Fd, and Fb, and the like, the case is illustrated in which the vertical length and horizontal width of the circumscribed rectangles Ft, Fd, and Fb are compared, but the comparison target is not limited thereto and may be, for example, only the horizontal width.

The vertical length may change due to elongation of the nail over time or the like, but the horizontal width hardly changes. For this reason, when the horizontal width of the original print outlines Ct and Cd and the base area B (the base outline Cb) change by a set value or more, it can be determined that there is a high possibility that the nail information detection unit 812 has erroneously recognized the outline. Therefore, it is preferable to issue an alert and request confirmation of a user before printing.

Further, in the present embodiment, a case is illustrated in which the base outline Cb is a print target area (the entire nail or a part of the nail T) where a white base is applied for improving color development or the like, it is not essential that a base be applied. When the base is not applied, the state where no preparation is applied to the nail T, or the state where the transparent base coat or the like for smoothing the nail surface or an ink receiver for receiving an ink is applied is the state ready for printing.

The present invention can be applied when the base outline at the time of printing is different from the registered outline Cr that is initially recognized and registered.

Figure 20A:
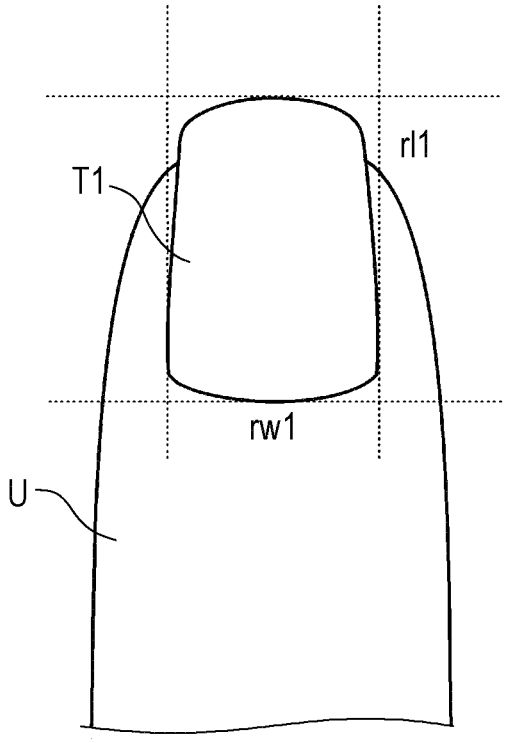
FIG. 20A is a diagram illustrating an example of a print outline according to a modification of the present embodiment.
Figure 20B:
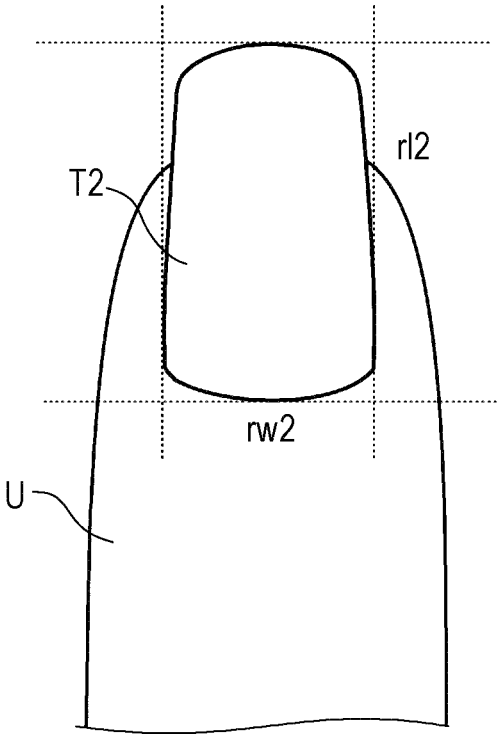
FIG. 20B is a diagram illustrating an example of a base outline according to a modification of the present embodiment.

For example, when the nail T1 of the finger U that is initially recognized has a vertical length tl1 and a horizontal width tw1, as illustrated in FIG. 20A, and when the nail T2 of the finger U recognized at the time of printing has a vertical length t12 and a horizontal width tw2 as illustrated in FIG. 20B, the outline comparison determination unit 813 may compare the two nails T1 and T2 at different recognition times to determine whether the difference is equal to or larger than a set value.

For example, the nail T elongates over time, and its shape (particularly, the vertical length) changes. For this reason, when the nail design is selected and prepared by fitting to the nail area, at the time when the registered outline Cr is initially registered, at the time of printing, if print data is to be generated from the fitted nail design, there is a risk that the arrangement and configuration of the nail design may collapse or be prolonged.

Figure 21:
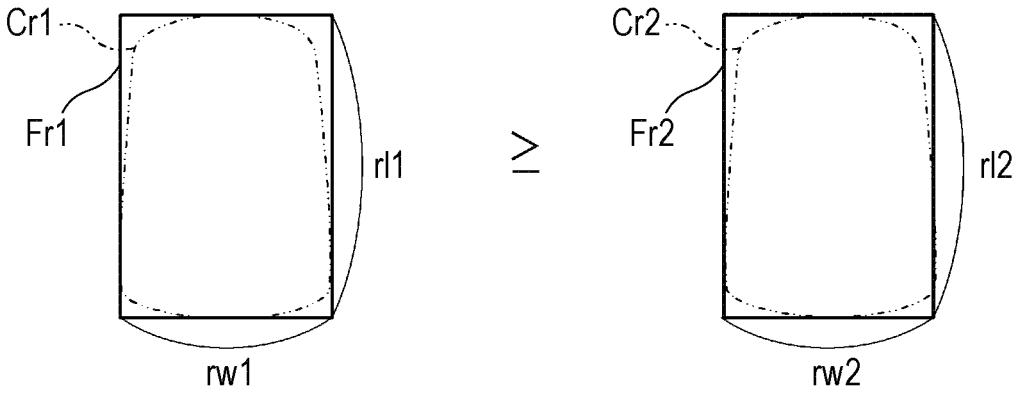
FIG. 21 is a diagram illustrating the case where, when a comparison is made between the print outline and the base outline of FIG. 20A, both are equal, or the latter is smaller.

In this regard, the outline (registered outline) of the nail T1 initially recognized and registered by the nail information detection unit 812 is Cr1, and the outline (base outline) of the nail T2 recognized at the time of printing is Cr2, when the circumscribed rectangles Fr1 and Fr2 are set respectively, if both the vertical length rl2 and the horizontal width rw2 of the circumscribed rectangle Fr2 of the base outline Cr2 are substantially equal to or smaller than the vertical length rl1 and the horizontal width rw1 of the circumscribed rectangle Fr1 of the registered outline Cr1 (refer to FIG. 21), the outline comparison determination unit 813 determines that the difference is smaller than the set value, and the printing process is continued.

Figure 22:
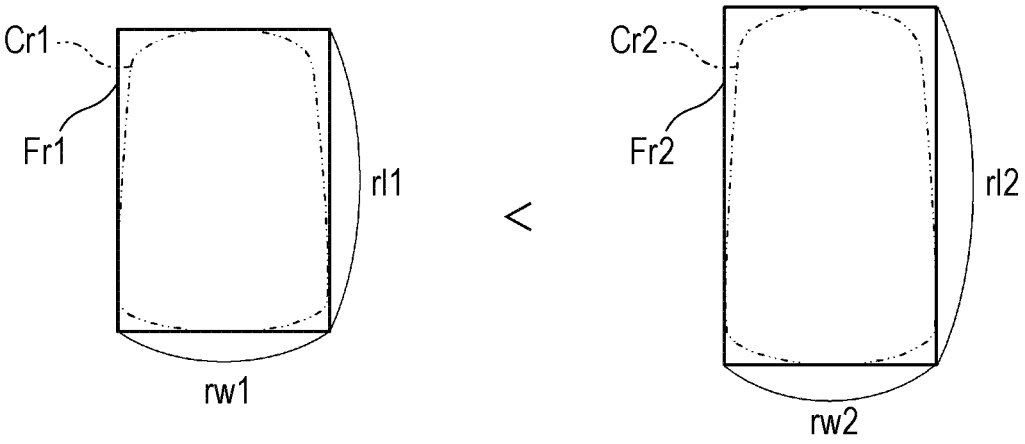
FIG. 22 is a diagram illustrating the case where, when a comparison is made between the print outline and the base outline of FIG. 20B, the latter is larger.

On the other hand, if any one of the vertical length rl2 and the horizontal width rw2 of the circumscribed rectangle Fr2 of the base outline Ct2 is larger than the vertical length rl1 and the horizontal width rw1 of the circumscribed rectangle Fr1 of the registered outline Cr1 (see FIG. 22), the outline comparison determination unit 813 may determine that the difference is equal to or larger than the set value and issue an alert to prompt the user to alert.

Note that the outline comparison determination unit 813 is not limited to performing the comparison and determination between the registered outline Cr1 and the base outline Cr2 based on the actual outline shape or the like.

For example, for the user, the tendency of how the nail T grows (such as how many millimeters it grows in one week) is registered and the shape of the base outline Cr2 (especially vertical length, nail length) are predicted according to the elapsed time since the registered outline Cr1 is detected, if there is a possibility that the shape has changed to a degree that cannot be ignored in fitting the nail design, an alert may be issued.

In this case, specifically, if the set value is 1 mm, and the user's nail T tends to extend 1 mm in eight days, if time has elapsed for eight days or more since the detection of the registered outline Cr1, the outline comparison determination unit 813 determines that the difference is equal to or larger than the set value, and for example, an alert is issued to alert the user.

In addition, the tendency of the extension of the nail T and the like may be set for each finger type even for the same user. In addition, even without strictly performing registration, setting, etc. for each user, by registering the age, gender, etc., the tendency of the extension of the nail T according to the age, gender, etc. is automatically set, and the outline comparison determination unit 813 may determine whether or not the difference is equal to or larger than a set value according to the automatically set tendency or the like.

In addition, when the nail T is cut, the information is also input to the device to be added to the registration information of the user, and the length of the nail T is reset to the initial state when the nail T is cut.

Further, in the present embodiment, the print processing mode is switched by the user selecting a desired nail design from the nail design for an entire nail and the nail design for a part of a nail, but the present invention is not limited to this.

For example, when the user selects the design mode for an entire nail or the design mode for a part of a nail, the print outlines Ct and Cd that match the selected mode may be displayed on the display unit 23. In this case, when the design mode for a part of a nail is selected, it is preferable that the adjustment can be appropriately performed such that the print outline Cd becomes the outline desired by the user. In such a case, the selection of the nail design and the fitting to the print outlines Ct and Cd may be performed immediately after the mode selection, or after the comparison of the outline of the base area. Alternatively, only the nail design selection may be performed immediately after the selection of the mode, and the fitting may be performed after the comparison of the base area.

Further, in the present embodiment, the case is illustrated that when applying nail design Da to the entire nail, at the stage before applying the base, the process of fitting the nail design Da to the nail T is not performed, the outline Ct of the nail T in the initial state is stored in the nail information storage region 822 of the storage unit 82 as the registered outline Cr, and the registered outline Cr which is the print outline Ct or the circumscribed rectangle Ft which is in contact with the print outline Ct (registered outline Cr) is compared with the base outline Cb. However, even when applying nail design Da to the entire nail, the fitted outline of the nail design Da may be stored in the nail information storage region 822 of the storage unit 82 as a print outline by performing the process of fitting the nail design Da to the nail T in the initial state before applying the base.

In addition, with respect to the registered outline, the circumscribed rectangle which is in contact with the outline of the nail T may be stored in the nail information storage region 822 of the storage unit 82 as a registered outline, instead of the outline itself of the nail T.

Further, in the present embodiment, it has been described that, in the design mode for a part of a nail, when there is a difference between the outline of the base area and the outline of the design by the set value or more, if it is caused by failure (protruding or unpainted) of the base coating by the user, the base protruding area B (Bo, refer to FIG. 11B) is removed, and a base is additionally applied to the unpainted area Bn to correct such that the base outline Cb becomes substantially same as the correct base area B. However, when the protrusion is not in the width direction of the nail T (when bw is not larger than dw), fitting of the nail design Df may be performed again in accordance with the outline of the base area. In this manner, for example, even when the outline of the root side of the nail T of the base outline Cb unexpectedly becomes a waveform, a nail design can include the waveform.

Further, in the present embodiment, the case is illustrated in which the nail design storage region 821, the nail information storage region 822, and the like are provided in the storage unit 82 of the control device 80, but each storage region is not necessarily provided in the storage unit 82 (ROM, RAM) of the control device 80, and a separate storage unit may be provided.

Further, information stored in an external terminal device may be used by associating the nail printer 1 with the external terminal device.

Further, the nail design image data may be provided in the storage unit of the terminal device, or may be stored in the storage unit of the nail printer 1.

Further, the nail design image data is stored in a server device or the like that can be connected via a network line or the like, and the terminal device or the nail printer 1 can access the server device or the like to refer to the nail design image data.

In this manner, it is possible to select a design to be printed from among more nail designs.

Further, in the present embodiment, an example is described in which the nail printer 1 can complete a printing operation by itself, but the nail printer 1 is not limited to the one described herein.

For example, the nail printer 1 forms a printing system in cooperation with the terminal device, and the terminal device may input a printing start instruction, detect a printing area (namely, a nail area), perform various corrections and generate print data, and the like. After that, the nail printer 1 may perform a printing operation for printing on nails. In this case, an operation unit and a display unit for inputting various instructions, a print data generation unit for generating print data, and the like are provided on the terminal device side that cooperates with the nail printer 1, and the control device of the terminal device may realize these functions.

Further, in the present embodiment, the nail printer 1 performs printing by an inkjet method, but the method of performing the printing by the nail printer 1 is not limited to the inkjet method.

For example, a pen holder for holding a printing pen for performing printing by bringing a pen tip into contact with the surface of the nail may be provided, and printing may be performed using the pen. In addition, both an ink-jet type printing unit as in the present embodiment and a pen holder for holding a printing pen may be provided to enable printing using a plurality of printing units.

Further, the nail printer 1 may be provided with a drying unit including a heater and a fan for drying an ink after printing.

For example, by providing a drying unit in a finger standby unit 350 or the like, it is possible to dry printed nails while performing printing on nails of other fingers, thereby the time required for nail printing can be reduced.

The embodiment according to the present invention has been described above. However, a scope of the present invention is not limited to the above-described embodiment, and the scope of the present invention described in Claims and a scope equivalent thereto are included.

Hereinafter, the inventions described in Claims initially appended to the application form of this application are appended. The item numbers of appended Claims are as set forth in Claims initially attached to the application form of this application.

The invention claimed is:

1. A printer, comprising:

a printing head configured to print on a printing area of a print target;

a processor configured to (i) detect an entire outline of the print target before application of a base to the print target and store the detected outline of the print target as a registered outline, (ii) detect a print outline, which is an outline of an area to be printed on the print target, based on the registered outline and a selected printing design, and (iii) detect, after application of the base to the print target, a base outline of the base, the base outline being an outline of a print target area where the base is applied in an area including the print target and a non-print target adjacent to the print target;

wherein the processor:

determines whether or not there is a difference equal to or larger than a set value by comparing the print outline with the base outline, and instructs to report when the difference is equal to or larger than the set value.

2. The printer according to claim 1, wherein:

the print target and the non-print target are a surface of a nail and a finger surface having the nail, respectively, the area to be printed is an area where a user wants to print, on an entirety of a surface of the print target or a part of the surface of the print target, the print target area is a base area where the base is applied on the print target and the non-print target, the processor compares aspect ratios of a vertical length and a horizontal width of a circumscribed rectangle set as the print outline and the base outline, and when the aspect ratios of both differ by a set value or more, the processor determines that the difference is equal to or more than the set value.

3. The printer according to claim 1, wherein:

the print target and the non-print target are a surface of a nail and a finger surface having the nail, respectively, the area to be printed is an area where a user wants to print, on an entirety of a surface of the print target or a part of the surface of the print target, the print target area is a base area where the base is applied on the print target and the non-print target, the processor compares vertical lengths and horizontal widths of circumscribed rectangles set as the print outline and the base outline, and when any one of the vertical length and horizontal width of the base outline is larger by the set value or more, the processor determines that the difference is equal to or more than the set value.

4. The printer according to claim 2, further comprising a storage unit configured to store nail information of the nail, wherein the storage unit stores an outline of the nail area detected by the processor as the registered outline.

5. The printer according to claim 1, wherein the processor causes the printing head to print on the printing area set based on a result of the determination by the processor.

6. The printer according to claim 1, wherein the area to be printed is a nail surface that is an area of a nail tip where a French nail is to be applied.

7. The printer according to claim 1, further comprising a display configured to display a display screen that prompts a user to correct the base outline when the difference determined by the processor is equal to or larger than the set value.

8. A printing method of a printer that prints on a printing area of a print target, the method comprising:

detecting an entire outline of the print target before application of a base to the print target and storing the detected outline of the print target as a registered outline;

detecting a print outline, which is an outline of an area to be printed on the print target, based on the registered outline and a selected printing design;

detecting, after application of the base to the print target, a base outline of the base, the base outline being an outline of a print target area where the base is applied in an area including the print target and a non-print target adjacent to the print target;

determining whether or not there is a difference equal to or larger than a set value by comparing the print outline with the base outline; and reporting to a user when the difference is equal to or larger than the set value.

9. A printer, comprising:

a printing head;

a memory configured to store information on an area to be printed on a print target; and a processor configured to (i) detect an entire outline of the print target before application of a base to the print target and store the detected outline of the print target as a registered outline, (ii) detect a print outline, which is an outline of the area to be printed on the print target, based on the registered outline and a selected printing design, and (iii) detect, after application of the base to the print target, a base outline of the base, the base outline being an outline of a print target area where the base is applied in an area including the print target and a non-print target adjacent to the print target;

wherein the processor determines whether or not there is a difference equal to or larger than a set value by comparing the registered outline or the print outline, with the base outline, and instructs to report when the difference is equal to or larger than the set value.

* * * * *